US011021315B2

(12) United States Patent
Jack et al.

(10) Patent No.: US 11,021,315 B2
(45) **Date of Patent: *Jun. 1, 2021**

(54) SPRAY CAP SYSTEM

(71) Applicant: Turtle Wax, Inc., Addison, IL (US)

(72) Inventors: Robert C. Jack, Arlington Heights, IL (US); Gary Cosentino, Addison, IL (US); Michael A. Schultz, Homer Glen, IL (US)

(73) Assignee: Turtle Wax, Inc., Addison, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/433,601

(22) Filed: Jun. 6, 2019

(65) Prior Publication Data

US 2019/0283958 A1 Sep. 19, 2019

Related U.S. Application Data

(63) Continuation of application No. 15/347,617, filed on Nov. 9, 2016, now Pat. No. 10,315,835.
(Continued)

(51) Int. Cl.
*B65D 83/28* (2006.01)
*A46B 11/00* (2006.01)
(Continued)

(52) U.S. Cl.
CPC ..... *B65D 83/285* (2013.01); *A46B 11/0017* (2013.01); *B05B 1/02* (2013.01);
(Continued)

(58) Field of Classification Search
CPC .. B65D 83/205; B65D 83/206; B65D 83/285; A46B 1/0017; B05B 1/02; B05B 1/3402; B05B 15/65
See application file for complete search history.

(56) References Cited

U.S. PATENT DOCUMENTS 2,281,367 A 4/1942 Moll
2,764,773 A 10/1956 Glanvill et al.
(Continued)

FOREIGN PATENT DOCUMENTS

CN 2144432 Y 10/1993
CN 1635843 A 7/2005
(Continued)

OTHER PUBLICATIONS

Advisory Action dated Jul. 16, 2018 in U.S. Appl. No. 29/555,926. (3 pages).
(Continued)

*Primary Examiner* — J C Jacyna
(74) *Attorney, Agent, or Firm* — Neal, Gerber & Eisenberg LLP; Thomas E. Williams

(57) ABSTRACT

A spray cap system is described that can enable a user to more consistently and accurately dispense and work with the contents of a spray can. The system includes a spray cap, spray button, spray nozzle, implement holder, and an implement (such as a brush, a foam pad applicator, or a sponge). By using the spray cap system, a user may achieve a more optimal discharge pattern of the contents of the can with a more efficient and optimal coverage of a surface. In addition, the user may utilize the implement while it is attached to the spray cap or remove the implement to use the implement independently. The spray cap system provides versatility to a user by enabling the user to spray the contents of the spray can regardless of whether the implement is attached to the spray cap.

20 Claims, 25 Drawing Sheets

Related U.S. Application Data

(60) Provisional application No. 62/299,881, filed on Feb. 25, 2016.

(51) Int. Cl.

| | |
|---|---|
| ***B05B 15/65*** | (2018.01) |
| ***B05B 1/02*** | (2006.01) |
| ***B65D 83/20*** | (2006.01) |
| *B05B 1/34* | (2006.01) |

(52) U.S. Cl.
CPC ..... *B05B 15/65* (2018.02); *B65D 83/205* (2013.01); *B05B 1/3402* (2018.08); *B65D 83/206* (2013.01)

(56) References Cited

U.S. PATENT DOCUMENTS

| | | | | |
|---|---|---|---|---|
| 2,820,234 | A | 1/1958 | Rigney | |
| 2,932,840 | A | 4/1960 | Lathrop | |
| D196,707 | S | 10/1963 | Anderson | |
| 3,137,885 | A | 6/1964 | Hulsh | |
| 3,148,401 | A | 9/1964 | Gilchrist et al. | |
| D199,959 | S | 1/1965 | Hulsh | |
| 3,184,781 | A * | 5/1965 | Hoxie | A47L 11/4036 401/22 |
| D208,224 | S | 8/1967 | Crowell | |
| 3,979,163 | A | 9/1976 | Beard | |
| 3,981,597 | A | 9/1976 | Cohn et al. | |
| 4,201,491 | A | 5/1980 | Kohler | |
| 4,260,110 | A | 4/1981 | Werding | |
| D260,236 | S | 8/1981 | Anderson et al. | |
| D272,235 | S | 1/1984 | Orlando | |
| 4,533,273 | A | 8/1985 | Obata et al. | |
| 4,557,619 | A | 12/1985 | DeVincentis | |
| D288,502 | S | 3/1987 | Barkley | |
| D289,109 | S | 4/1987 | Buecheler | |
| D296,763 | S | 7/1988 | Holmstadt et al. | |
| 4,938,621 | A * | 7/1990 | Pyrozyk | A46B 11/0017 132/112 |
| D317,832 | S | 7/1991 | Demarest | |
| D322,391 | S | 12/1991 | Morane | |
| D333,730 | S | 3/1993 | Martin | |
| 5,299,877 | A | 4/1994 | Birden | |
| D369,976 | S | 5/1996 | Koptis | |
| D376,697 | S | 12/1996 | Green et al. | |
| D385,789 | S | 11/1997 | Koptis | |
| D386,853 | S | 11/1997 | Koptis | |
| D386,854 | S | 11/1997 | Koptis | |
| D386,855 | S | 11/1997 | Koptis | |
| D388,545 | S | 12/1997 | Antonopoulos-McIvor | |
| 5,772,077 | A | 6/1998 | Tafur | |
| D398,235 | S | 9/1998 | Koptis | |
| D405,572 | S | 2/1999 | Bouchez | |
| D416,388 | S | 11/1999 | Koptis | |
| D418,303 | S | 1/2000 | Koptis | |
| 6,050,271 | A | 4/2000 | Spencer | |
| 6,092,952 | A | 7/2000 | Eberle | |
| D433,235 | S | 11/2000 | Koptis | |
| 6,227,740 | B1 | 5/2001 | Stear et al. | |
| 6,371,675 | B1 | 4/2002 | Hoang et al. | |
| D459,026 | S | 6/2002 | Zigmans | |
| 6,425,701 | B1 | 7/2002 | Jacobs | |
| D466,305 | S | 12/2002 | Seo | |
| 6,637,440 | B2 | 10/2003 | de Laforcade | |
| 7,007,338 | B2 | 3/2006 | Garabedian, Jr. et al. | |
| 7,040,830 | B2 | 5/2006 | Kliegman et al. | |
| D527,489 | S | 8/2006 | Angeletta | |
| D533,721 | S | 12/2006 | Urra | |
| D609,014 | S | 2/2010 | Hill | |
| 7,658,568 | B1 | 2/2010 | Armstrong et al. | |
| 7,682,097 | B2 | 3/2010 | Knopow et al. | |
| D640,873 | S | 7/2011 | Seehoff et al. | |
| D654,792 | S | 2/2012 | Bertelsen | |
| D657,957 | S | 4/2012 | Camp | |
| D660,005 | S | 5/2012 | Prague et al. | |
| 8,475,070 | B1 | 7/2013 | Miner et al. | |
| 8,533,894 | B2 | 9/2013 | Watanabe et al. | |
| 8,834,054 | B2 | 9/2014 | Gallardo | |
| D724,285 | S | 3/2015 | Michelson et al. | |
| D743,703 | S | 11/2015 | Harrington et al. | |
| D750,492 | S | 3/2016 | Campbell et al. | |
| 9,307,880 | B2 | 4/2016 | Cagnina et al. | |
| D763,081 | S | 8/2016 | Cardinal et al. | |
| D766,084 | S | 9/2016 | Jiang | |
| D787,830 | S | 5/2017 | Jack et al. | |
| D787,831 | S | 5/2017 | Jack et al. | |
| D797,462 | S | 9/2017 | Lee | |
| 9,980,554 | B2 | 5/2018 | Chen | |
| D822,388 | S | 7/2018 | Barsoum | |
| D824,679 | S | 8/2018 | Ramos | |
| 10,071,399 | B2 | 9/2018 | Perlas et al. | |
| D840,172 | S | 2/2019 | Makiuchi et al. | |
| D841,912 | S | 2/2019 | Renner et al. | |
| D845,001 | S | 4/2019 | Jack et al. | |
| 10,315,835 | B2 * | 6/2019 | Jack | B05B 1/02 |
| 2007/0127977 | A1 | 6/2007 | Aiken | |
| 2010/0266329 | A1 | 10/2010 | Feo | |
| 2013/0008540 | A1 * | 1/2013 | Shah | B05B 1/3426 137/808 |
| 2015/0272308 | A1 | 10/2015 | Harrington et al. | |
| 2015/0306607 | A1 | 10/2015 | Romanov et al. | |
| 2017/0247173 | A1 | 8/2017 | Jack et al. | |

FOREIGN PATENT DOCUMENTS

| | | | |
|---|---|---|---|
| CN | 200974682 | Y | 11/2007 |
| CN | 101918290 | A | 12/2010 |
| CN | 201793148 | U | 4/2011 |
| CN | 105228925 | A | 1/2016 |
| EA | 003350347-0003 | | 9/2016 |
| GB | 999593 | | 7/1965 |
| WO | 98/51587 | | 11/1998 |
| WO | 01/62122 | A2 | 8/2001 |

OTHER PUBLICATIONS

After Final Response dated Jul. 2, 2018 in U.S. Appl. No. 29/555,926. (4 pages).

Claimed Design—"Turtle Wax T-244R1 Power Out! Carpet Cleaner and Odor Eliminator 18 oz by Turtle Wax," [on-line]; [Internet "date first available" of the product Apr. 17, 2012]; [retrieved on Sep. 26, 2018]; URL https://www.amazon.com.uk/Turtle-Wax-T-244R1-Cleaner-Eliminator/dp/B003WJCX92 (2012) (5 pages).

English translation of Nonfinal Office Action dated Aug. 24, 2018 in Chinese Patent Application No. 201680004128.2 (12 pages).

European Extended Search Report for European Patent Application No. 16858478.7 dated Aug. 24, 2018 (10 pages).

Final Office Action dated May 1, 2018 in U.S. Appl. No. 29/555,926. (6 pages).

How to Use Turtle Wax ICE Heavy Duty Floor Mat & Carpet Cleaner, [on-line video]; [published to the Internet by Turtle Wax on May 1, 2015]; [retrieved from the Internet on Jul. 26, 2017]; URL: https://www.youtube.com/watch?v=t205bJOGQJ4. (2 pages).

International Preliminary Report on Patentability dated Aug. 28, 2018 for PCT Application No. PCT/US2016/061169 (7 pages).

International Search Report and Written Opinion dated Jan. 17, 2017 for PCT Application No. PCT/US2016/061169 (17 pages).

Nonfinal Office Action dated Aug. 24, 2018 in Chinese Patent Application No. 201680004128.2 (11 pages).

Nonfinal Office Action dated Aug. 9, 2017 in U.S. Appl. No. 29/555,926. (8 pages).

Old Design—Google Image Search—"Turtle Wax T-244R1 Power Out!," [on-line]; [Internet publication date unknown]; [retrieved on Sep. 26, 2018]; URL: see provided copy (2018) (2 pages).

Response to Nonfinal Office Action dated Dec. 14, 2017 in U.S. Appl. No. 29/555,926. (14 pages).

Turtle Wax Power Out Carpet & Mats Heavy Duty Cleaner, [on-line video]; [published to the Internet by Turtle Wax on Oct. 28, 2016];

(56) References Cited

OTHER PUBLICATIONS

[retrieved from the Internet on Jul. 26, 2017]; URL: https://www.youtube.com/watch?v=dWzT9_pz6kw. (3 pages).
Turtle Wax T-244R1 Power Out . . . [on-line]; [item first available on Jul. 20, 2010]; [retrieved from the Internet on Jul. 26, 2017]; URL: see provided copy for URL address. (8 pages).
Unpublished pending U.S. Appl. No. 29/555,924, filed Feb. 25, 2016, which is not being furnished herewith, pursuant to the Commissioner's Notice dated Sep. 21, 2004.
Unpublished pending U.S. Appl. No. 29/555,926, filed Feb. 25, 2016, which is not being furnished herewith, pursuant to the Commissioner's Notice dated Sep. 21, 2004.
US Trademark Application #75515641 (now Registered Trademark #2363103) for "Power Out," filed on Jul. 8, 1998 by Turtle Wax Inc. First use in commerce date Dec. 1998. Retrieved on Jul. 26, 2017. (6 pages).

* cited by examiner

SPRAY CAP SYSTEM

CROSS-REFERENCE TO RELATED APPLICATIONS

This application is a continuation of U.S. Non-Provisional patent application Ser. No. 15/347,617, filed on Nov. 9, 2016, which claims the benefit of U.S. Provisional Application No. 62/299,881, filed Feb. 25, 2016. These applications are incorporated herein by reference in their entirety.

TECHNICAL FIELD

This application generally relates to a spray cap system for dispensing the contents from a spray can and for enabling the use of an implement, such as a brush or foam pad applicator. In particular, this application relates to a spray cap system having a spray cap, spray button, spray nozzle, implement holder, and implement that enables a user to more consistently and accurately dispense and work with the contents from a spray can.

BACKGROUND

Existing spray cans typically include a spray tip through which the contents of the can are dispensed when an actuator, such as a button, is depressed by a user. A valve on top of the can may be opened when the actuator is depressed such that the contents of the can are forced out through an orifice of the spray tip onto a surface, for example. However, existing spray tips typically have a relatively uncontrolled discharge pattern that may create blotchy and sporadic placement, and result in the uneven and inconsistent coverage of a surface.

These relatively uncontrolled discharge patterns may be caused at least in part by the suboptimal design of orifices of existing spray tips and/or their flow chambers, which lead to suboptimal discharge patterns and surface coverages. Existing spray tips may also not be able to prevent the orifice from rotating.

In addition, the path that the contents of the can travels when dispensed from the valve may contribute to an uncontrolled discharge pattern. For example, when the valve on top of the can is opened, the contents of the can may travel through the valve then perpendicularly out through the orifice of the spray tip, such as in a 90 degree spray discharge arrangement. Existing spray tips with a perpendicular discharge flow path typically include a flow rod for controlling and compressing the flow of the contents of the can up to and through the orifice. Such flow rods may also extend out through the spray tip to assist in compressing the contents of the can before the contents are discharged through the orifice.

Furthermore, some existing spray caps on spray cans may include an integrated brush, a foam pad applicator, or a sponge, but no such spray caps permit interchangeability of one implement for another. Moreover, such integrated implements may be awkward and difficult to use in some situations, such as in small, tight, or narrow areas, due to the need for the user to manipulate the entire can and spray cap when using the implement. In addition, integrated implements cannot be removed from the spray caps while maintaining the ability to dispense the contents of the can. While some existing spray caps may have removable implements, these types of existing spray caps are typically not ergonomically designed to be comfortably used and do not have locking mechanisms to secure the implement to the spray cap.

Accordingly, there is an opportunity for a system that addresses these concerns. More particularly, there is an opportunity for a spray cap system that enables a user to more consistently and accurately dispense and work with the contents of a spray can.

SUMMARY

An implement spray cap system for more consistent and accurate dispensing of contents of a spray can and enabling use of an implement is disclosed. In this embodiment, the implement spray cap system includes: (A) a spray cap adapted to attach to a spray end portion of a spray can, the spray cap comprising a generally cylindrical tapered skirt adapted to fit over a top portion of the can, a recessed area formed by a cap sidewall extending upwardly from the skirt, and a nozzle opening formed through the cap sidewall; (B) a spray button moveably positioned in the recessed area of the spray cap, the spray button comprising a top surface, a button sidewall extending downwardly from the top surface, a nozzle receiver disposed on an outer surface of the button sidewall and engaged with the nozzle opening of the spray cap, and a flow chamber for conveying the contents of the can to the nozzle receiver; (C) a spray nozzle engaged with the nozzle receiver of the spray button, the spray nozzle comprising an elongated chamber having fluted inner walls for directing a flow of the contents of the can, a bowtie-shaped orifice in communication with the chamber, and first and second trapezoidal protrusions disposed on an outer face of the spray nozzle and positioned parallel to the orifice, the first protrusion positioned on one side of the orifice and the second protrusion positioned on the other side of the orifice; (D) an implement holder removably engaged with the spray cap, the implement holder comprising a holder backplane comprising a flexible cantilevered hinge lockingly engaged with the spray cap, a receiving slot slidingly engaged with the spray cap to attach the implement holder to the spray cap, an implement receiving portion formed by a sidewall extending from the holder backplane, the implement receiving portion comprising a locking mechanism adapted to removably secure the implement to the implement receiving portion, a holder nozzle opening formed through the holder backplane, and a plurality of scrubbing knurlings disposed on a surface opposite of the holder backplane; and (E) an implement assembly removably engaged with the implement holder, comprising an implement backplane removably secured to the implement receiving portion of the implement holder, an implement nozzle opening formed through the implement backplane and interfaced with the holder nozzle opening, and the implement arranged on the implement backplane.

The implement may include a brush comprising a plurality of resilient bristles formed on a surface opposite of the implement backplane, wherein a subset of the plurality of bristles is arranged to form an angled portion of the brush. The implement may include a brush comprising a plurality of resilient bristles mounted on the implement backplane, wherein a subset of the plurality of bristles is arranged to form an angled portion of the brush. The implement may include a foam pad applicator comprising a foam pad mounted on the implement backplane.

The spray cap may further include a substantially flat plate disposed on an outer surface of the sidewall, the plate comprising at least one mating aperture formed thereon, the at least one mating aperture adapted to interface with the implement holder.

The flow chamber of the spray button may include a first portion having an end adapted to interface with a valve stem of the can, and a second portion substantially perpendicular to and in communication with the first portion, the second portion extending from the first portion to the nozzle receiver.

The spray nozzle may further include a plurality of protrusions and a plurality of recesses disposed circumferentially about one end of the spray nozzle, the plurality of protrusions and the plurality of recesses adapted to mate with corresponding recesses and protrusions of the spray cap to maintain an orientation of the spray nozzle relative to the nozzle receiver and to prevent rotational movement of the spray nozzle relative to the nozzle receiver.

The spray button may be cantilevered from the nozzle receiver such that a central portion of the spray button is moveable when depressed. The recessed area of the spray cap may include a lip and a generally planar shelf portion extending laterally from an inner surface of the sidewall, wherein the lip and the shelf portion are adapted to engage with a rim of the can for attaching the spray cap to the can.

The flexible cantilevered hinge may include at least one locking protrusion at a distal end of the hinge, the at least one locking protrusion adapted to engage with at least one corresponding mating aperture of the spray cap, and a stop protruding from the hinge, the stop adapted to align the at least one locking protrusion with the at least one mating aperture. The hinge may be cantilevered such that the at least one locking protrusion is adapted to disengage from the at least one mating aperture of the spray cap when the hinge is depressed.

The holder nozzle opening may be formed by a wall extending from the holder backplane, and the holder nozzle opening is adjacent to the hinge. Each of the holder nozzle opening and the implement nozzle opening may be generally oblong. The locking mechanism of the implement receiving portion may include a plurality of detents to secure the implement to the implement receiving portion. The surface having the plurality of scrubbing knurlings disposed thereon may be angled. The implement may be secured to the implement backplane.

In an embodiment, a spray cap adapted to attach to a spray end portion of a spray can is disclosed, comprising a generally cylindrical tapered skirt adapted to fit over a top portion of the can, a recessed area formed by a sidewall extending upwardly from the skirt, the recessed area adapted to accept a spray button, the recessed area comprising a generally circular aperture adapted to attach to a rim of the can, and a generally planar shelf portion extending laterally from an inner surface of the sidewall, a substantially flat plate disposed on an outer surface of the sidewall, the plate comprising at least one mating aperture formed thereon, the at least one mating aperture adapted to engage with an implement holder, and a nozzle opening formed through the sidewall and the plate.

The recessed area may further include at least one anti-rotation protrusion formed on the inner surface of the sidewall, the at least one anti-rotation protrusion adapted to restrict rotation of the spray cap with respect to the can. The recessed area may further include a keyed locking structure adapted to engage with and retain the spray button. The keyed locking structure may include a plurality of engagement protrusions adapted to engage with a nozzle opening of the spray button.

A portion of a top edge of the sidewall may be integral with a portion of a top edge of the plate. The nozzle opening may be formed at a first end of the sidewall, and the shelf portion of the recessed area may extend laterally from the inner surface of the sidewall on a second end of the sidewall opposite the first end. The plate may be adapted to mate with a receiving slot of the implement holder. The at least one mating aperture may be further adapted to engage with at least one corresponding locking protrusion of the implement holder. The generally circular aperture may include a lip, and the lip and the shelf portion may be adapted to engage with the rim of the can for attaching the spray cap to the can.

In an embodiment, a spray button for dispensing contents from a spray can and adapted to a spray cap is disclosed, comprising a top surface, a sidewall extending downwardly from the top surface, a nozzle receiver disposed on an outer surface of the sidewall, the nozzle receiver adapted to accept a spray nozzle and interface with a nozzle opening of the spray cap, and a flow chamber for conveying the contents of the can to the nozzle receiver, the flow chamber comprising a first portion having an end adapted to interface with a valve stem of the can and a second portion substantially perpendicular to and in communication with the first portion, the second portion extending from the first portion to the nozzle receiver.

The nozzle receiver may include at least one engager adapted to retain the spray nozzle to the nozzle receiver. The nozzle receiver may include an orientation element disposed on an outer surface of the nozzle receiver, the orientation element adapted to maintain an orientation of the spray nozzle and to prevent rotational movement of the spray nozzle relative to the nozzle receiver. The orientation element may include a plurality of protrusions and a plurality of recesses that are disposed circumferentially on the outer surface of the nozzle receiver, wherein the plurality of protrusions is adapted to mate with corresponding recesses on the spray nozzle and the plurality of recesses is adapted to mate with corresponding protrusions on the spray nozzle. An inner surface of the second portion of the flow chamber may include a circumferential retaining element adapted to interface with a circumferential locking detent of the spray nozzle.

In an embodiment, a spray nozzle for dispensing contents from a spray can and adapted for attachment to a nozzle receiver of a spray button is disclosed, comprising an elongated chamber having fluted inner walls for directing a flow of the contents of the can, a bowtie-shaped orifice in communication with the chamber, first and second trapezoidal protrusions disposed on an outer face of the spray nozzle and positioned parallel to the orifice, the first protrusion positioned on one side of the orifice and the second protrusion positioned on the other side of the orifice, and an orientation element disposed circumferentially about one end of the spray nozzle, the orientation element adapted to maintain an orientation of the spray nozzle relative to the nozzle receiver and to prevent rotational movement of the spray nozzle relative to the nozzle receiver.

The inner walls may include a plurality of laminar flow channels. The orientation element may include a plurality of protrusions and a plurality of recesses that are disposed circumferentially about the outer face of the spray nozzle, wherein the plurality of protrusions is adapted to mate with corresponding recesses on the nozzle receiver and the plurality of recesses is adapted to mate with corresponding protrusions on the nozzle receiver. The first and second protrusions may be adapted to direct the contents of the can as the contents are expelled through the orifice during operation. An outer surface of the elongated chamber may include a circumferential locking detent adapted to interface with a circumferential retaining element of the nozzle receiver of the spray button.

In an embodiment, a spray button apparatus for dispensing contents from a spray can is disclosed, comprising: (A) a spray button comprising a top surface, a sidewall extending downwardly from the top surface, a nozzle receiver disposed on an outer surface of the sidewall, and a flow chamber for conveying the contents of the can to the nozzle receiver, the flow chamber comprising a first portion having an end adapted to interface with a valve stem of the can, and a second portion substantially perpendicular to and in communication with the first portion, the second portion extending from the first portion to the nozzle receiver; and (B) a spray nozzle engaged with the nozzle receiver of the spray button, the spray nozzle comprising an elongated chamber having fluted inner walls for directing a flow of the contents of the can, a bowtie-shaped orifice in communication with the chamber, first and second trapezoidal protrusions disposed on an outer face of the spray nozzle and positioned parallel to the orifice, the first protrusion positioned on one side of the orifice and the second protrusion positioned on the other side of the orifice, and a tip orientation element disposed circumferentially about one end of the spray nozzle, the tip orientation element adapted to maintain an orientation of the spray nozzle relative to the nozzle receiver and to prevent rotational movement of the spray nozzle relative to the nozzle receiver.

The nozzle receiver may include an aperture orientation element disposed on an outer surface of the nozzle receiver, the aperture orientation element engaged with the tip orientation element of the spray nozzle. The aperture orientation element may include a first plurality of protrusions and a first plurality of recesses that are disposed circumferentially on the outer surface of the nozzle receiver, the tip orientation element may include a second plurality of protrusions and a second plurality of recesses that are disposed circumferentially about the outer face of the spray nozzle, the first plurality of protrusions may be engaged with the second plurality of recesses, and the first plurality of recesses may be engaged with the second plurality of protrusions. An outer surface of the spray nozzle may further include a circumferential locking detent, and an inner surface of the second portion of the flow chamber of the spray button may include a circumferential retaining element engaged with the locking detent of the spray nozzle. The inner walls may include a plurality of laminar flow channels. The first and second protrusions may be adapted to deflect the contents of the can as the contents are expelled through the orifice during operation.

In an embodiment, a spray cap system for dispensing contents from a spray can is disclosed, comprising: (A) a spray cap adapted to attach to a spray end portion of the can, the spray cap comprising a generally cylindrical tapered skirt adapted to fit over a top portion of the can, a recessed area formed by a cap sidewall extending upwardly from the skirt, and a nozzle opening formed through the cap sidewall; (B) a spray button moveably arranged in the recessed area of the spray cap, the spray button comprising a top surface, a button sidewall extending downwardly from the top surface, a nozzle receiver disposed on an outer surface of the button sidewall and engaged with the nozzle opening of the spray cap, and a flow chamber for conveying the contents of the can to the nozzle receiver; and (C) a spray nozzle engaged with the nozzle receiver of the spray button, the spray nozzle comprising an elongated chamber having fluted inner walls for directing a flow of the contents of the can, a bowtie-shaped orifice in communication with the chamber, and first and second trapezoidal protrusions disposed on an outer face of the spray nozzle and positioned parallel to the orifice, the first protrusion positioned on one side of the orifice and the second protrusion positioned on the other side of the orifice.

The spray cap may further include a substantially flat plate disposed on an outer surface of the cap sidewall, the plate comprising at least one mating aperture formed thereon, the at least one mating aperture adapted to interface with an implement holder. The flow chamber of the spray button may include a first portion having an end adapted to interface with a valve stem of the can, and a second portion substantially perpendicular to and in communication with the first portion, the second portion extending from the first portion to the nozzle receiver. The spray nozzle may further include an orientation element disposed circumferentially about one end of the spray nozzle, the orientation element adapted to maintain an orientation of the spray nozzle relative to the nozzle receiver and to prevent rotational movement of the spray nozzle relative to the nozzle receiver. The spray button may be cantilevered from the nozzle receiver such that a central portion of the spray button is moveable when depressed. The recessed area of the spray cap may include a generally planar shelf portion extending laterally from an inner surface of the cap sidewall. The recessed area may further include a lip, wherein the lip and the shelf portion are adapted to engage with a rim of the can for attaching the spray cap to the can.

In an embodiment, an implement holder adapted to be removably attached to a spray cap is disclosed, comprising a backplane comprising a flexible cantilevered hinge having at least one locking protrusion at a distal end of the hinge, the at least one locking protrusion adapted to engage with at least one corresponding mating aperture of the spray cap, and a stop protruding from the hinge, the stop adapted to align the at least one locking protrusion with the at least one mating aperture, and a receiving slot adapted to slidingly engage with a plate of the spray cap to attach the implement holder to the spray cap, an implement receiving portion formed by a sidewall extending from the backplane, the implement receiving portion adapted to accept an implement, the implement receiving portion comprising a locking mechanism adapted to removably secure the implement to the implement receiving portion, a nozzle opening formed through the backplane, and a plurality of scrubbing knurlings disposed on a surface opposite of the backplane.

The nozzle opening may be formed by a wall extending from the backplane, and the nozzle opening may be adjacent to the hinge. The nozzle opening may be generally oblong. The nozzle opening may be adapted to interface with a corresponding opening of the implement. The locking mechanism of the implement receiving portion may include a plurality of detents to secure the implement to the implement receiving portion. The hinge may be cantilevered such that the at least one locking protrusion is adapted to disengage from the at least one mating aperture of the spray cap when the hinge is depressed. The surface having the plurality of scrubbing knurlings disposed thereon may be angled.

In an embodiment, a brush assembly adapted for attachment to an implement holder is disclosed, comprising a backplane adapted to be secured to an implement receiving portion of the implement holder, a nozzle opening formed through the backplane, and a brush comprising a plurality of resilient bristles formed on a surface opposite of the backplane, wherein a subset of the plurality of bristles is arranged to form an angled portion of the brush.

The subset of the plurality of bristles may be formed on a first portion of the surface opposite of the backplane, and each of the remainder of the plurality of bristles may have substantially the same length and may be disposed on a second portion of the surface opposite of the backplane. The nozzle opening may be generally oblong. The nozzle opening may be adapted to interface with a corresponding opening of the implement receiving portion. The brush may be secured to the backplane. The backplane may include an angled perimeter guide adapted to help urge insertion of the brush assembly into the implement holder.

In an embodiment, a brush holder system adapted to attach to a spray cap is disclosed, comprising: (A) a brush holder comprising a holder backplane comprising a flexible cantilevered hinge adapted to engage with the spray cap, a receiving slot adapted to slidingly engage with a plate of the spray cap to attach the brush holder to the spray cap, a brush receptacle formed by a sidewall extending from the holder backplane, the brush receptacle comprising a locking mechanism adapted to removably secure a brush assembly to the brush receptacle, a holder nozzle opening formed through the holder backplane, and a plurality of scrubbing knurlings disposed on a surface opposite of the holder backplane; and (B) the brush assembly removably engaged with the brush holder, comprising a brush backplane removably secured to the brush receptacle of the brush holder, a brush nozzle opening formed through the brush backplane and interfaced with the holder nozzle opening, and a brush comprising a plurality of resilient bristles formed on a surface opposite of the brush backplane, wherein a subset of the plurality of bristles is arranged to form an angled portion of the brush.

The flexible cantilevered hinge may include at least one locking protrusion at a distal end of the hinge, the at least one locking protrusion adapted to engage with at least one corresponding mating aperture of the spray cap, and a stop protruding from the hinge, the stop adapted to align the at least one locking protrusion with the at least one mating aperture. The hinge may be cantilevered such that the at least one locking protrusion is adapted to disengage from the at least one mating aperture of the spray cap when the hinge is depressed. The holder nozzle opening may be formed by a wall extending from the holder backplane, and the holder nozzle opening is adjacent to the hinge. Each of the holder nozzle opening and the brush nozzle opening may be generally oblong. The locking mechanism of the brush receptacle may include a plurality of detents to secure the brush assembly to the brush receptacle. The surface having the plurality of scrubbing knurlings disposed thereon may be angled. The brush may be secured to the brush backplane. The backplane may include an angled perimeter guide adapted to help urge insertion of the brush assembly into the brush holder.

In an embodiment, a foam pad applicator assembly adapted for attachment to an implement holder is disclosed, comprising a backplane adapted to be secured to an implement receiving portion of the implement holder, a nozzle opening formed through the backplane, and a foam pad applicator comprising a foam pad secured on a surface opposite of the backplane.

The nozzle opening may be generally oblong. The nozzle opening may be adapted to interface with a corresponding opening of the implement receiving portion. The foam pad applicator may be secured to the backplane. The backplane may include an angled perimeter guide adapted to help urge insertion of the foam pad applicator assembly into the implement holder.

In an embodiment, a foam pad applicator holder system adapted to attach to a spray cap is disclosed, comprising: (A) a foam pad applicator holder comprising a holder backplane comprising a flexible cantilevered hinge adapted to engage with the spray cap, a receiving slot adapted to slidingly engage with a plate of the spray cap to attach the foam pad applicator holder to the spray cap, a foam pad applicator receptacle formed by a sidewall extending from the holder backplane, the foam pad applicator receptacle comprising a locking mechanism adapted to removably secure a foam pad applicator assembly to the foam pad applicator receptacle, a holder nozzle opening formed through the holder backplane, and a plurality of scrubbing knurlings disposed on a surface opposite of the holder backplane; and (B) the foam pad applicator assembly removably engaged with the foam pad applicator holder, comprising a foam pad applicator backplane removably secured to the foam pad applicator receptacle of the foam pad applicator holder, a foam pad applicator nozzle opening formed through the foam pad applicator backplane and interfaced with the holder nozzle opening, and a foam pad secured on a surface opposite of the foam pad applicator backplane.

The flexible cantilevered hinge may include at least one locking protrusion at a distal end of the hinge, the at least one locking protrusion adapted to engage with at least one corresponding mating aperture of the spray cap, and a stop protruding from the hinge, the stop adapted to align the at least one locking protrusion with the at least one mating aperture. The hinge may be cantilevered such that the at least one locking protrusion is adapted to disengage from the at least one mating aperture of the spray cap when the hinge is depressed. The holder nozzle opening may be formed by a wall extending from the holder backplane, and the holder nozzle opening may be adjacent to the hinge. Each of the holder nozzle opening and the foam pad applicator nozzle opening may be generally oblong.

The locking mechanism of the foam pad applicator receptacle may include a plurality of detents to secure the foam pad applicator assembly to the foam pad applicator receptacle. The surface having the plurality of scrubbing knurlings disposed thereon may be angled. The foam pad may be secured to the foam pad applicator backplane. The foam pad applicator backplane may include an angled perimeter guide adapted to help urge insertion of the foam pad applicator assembly into the foam pad applicator holder.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
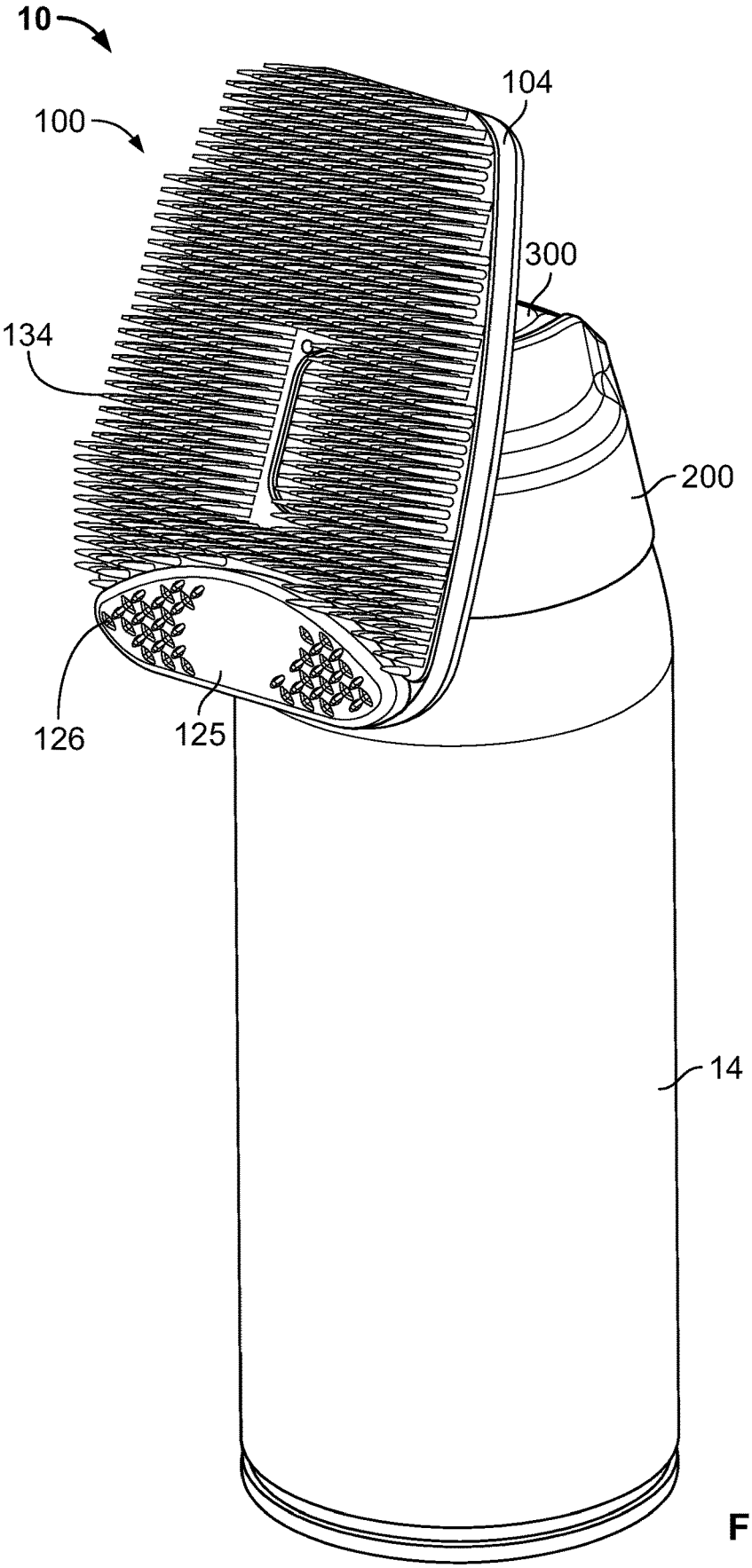
FIG. 1 is a front perspective view of an embodiment of an assembled spray cap system including a brush, shown installed on a representative can.

The description that follows describes, illustrates and exemplifies one or more embodiments of the invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also any other embodiment that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. As stated above, this specification is intended to be taken as a whole and interpreted in accordance with the principles of the invention as taught herein and understood by one of ordinary skill in the art.

The spray cap system and its components described herein can enable a user of a spray can to more consistently and accurately dispense the contents from the can. For example, the contents of a spray can may include a liquid or a foam, such as a cleaning agent for use as a cleaner, a stain remover, or a conditioner for use on various surfaces, including for example, a fabric, a vinyl, a leather, and carpet, or any other surface on which it is desired to dispense the contents of the spray can. A user of the spray cap system can dispense the contents from the can onto a surface by depressing a spray button that is movable relative to a spray cap on top of the can. The contents of the can may be dispensed from a valve of the can through a flow chamber of the spray button and out through a spray nozzle having a flow-straightening chamber and a bowtie-shaped orifice. The flow chamber of the spray button and the flow-straightening chamber of the spray nozzle may convey and guide the contents of the can and through the orifice so as to dispense the contents in an optimal discharge pattern and with a more efficient and optimal surface coverage. In addition, in some embodiments, paddle-like protrusions on the face of the spray nozzle that are positioned parallel to the orifice may assist in controlling and directing the flow of the contents of the can onto the surface in a more optimal manner.

The spray cap system and its components described herein may also enable a user of a spray can to more efficiently work with the dispensed contents of the can on a surface. For example, once the contents of the can, such as a cleaning agent, have been dispensed onto a surface, the user may desire to rub, scrub, and/or work in the dispensed contents on the surface. An implement, such as, for example, a brush, a foam pad applicator, or a sponge, may be removably attached to an implement holder, and the implement holder may be removably attached to the spray cap to allow use of the implement independently of the use of spraying of contents from the can. The implement may be removably secured to the implement holder. The implement holder may be configured to interchangeably receive any number of different implements, thereby providing manufacturing flexibility for marketing different can contents while minimizing tooling costs due to the universal design of the implement holder and to enable a user to quickly substitute one implement for another during use. In some embodiments, the implement is removably secured to the implement holder via a backplane, adapter, or other suitable interface, which backplane, adapter or other suitable interface may be integrally formed as a part of the implement or may be a separate component altogether. The implement can be used while attached to the spray cap, or if a user desires, the implement holder and the implement may be removed from the spray cap and used independently from the spray cap and the can, such as in environments that have small, tight, and/or narrow areas. In this latter situation, the implement can be used independently from the spray can, and the components that remain attached to the spray can enable a user to spray the contents of the spray can from the spray can while the implement and implement holder are removed from the spray can.

Figure 2:
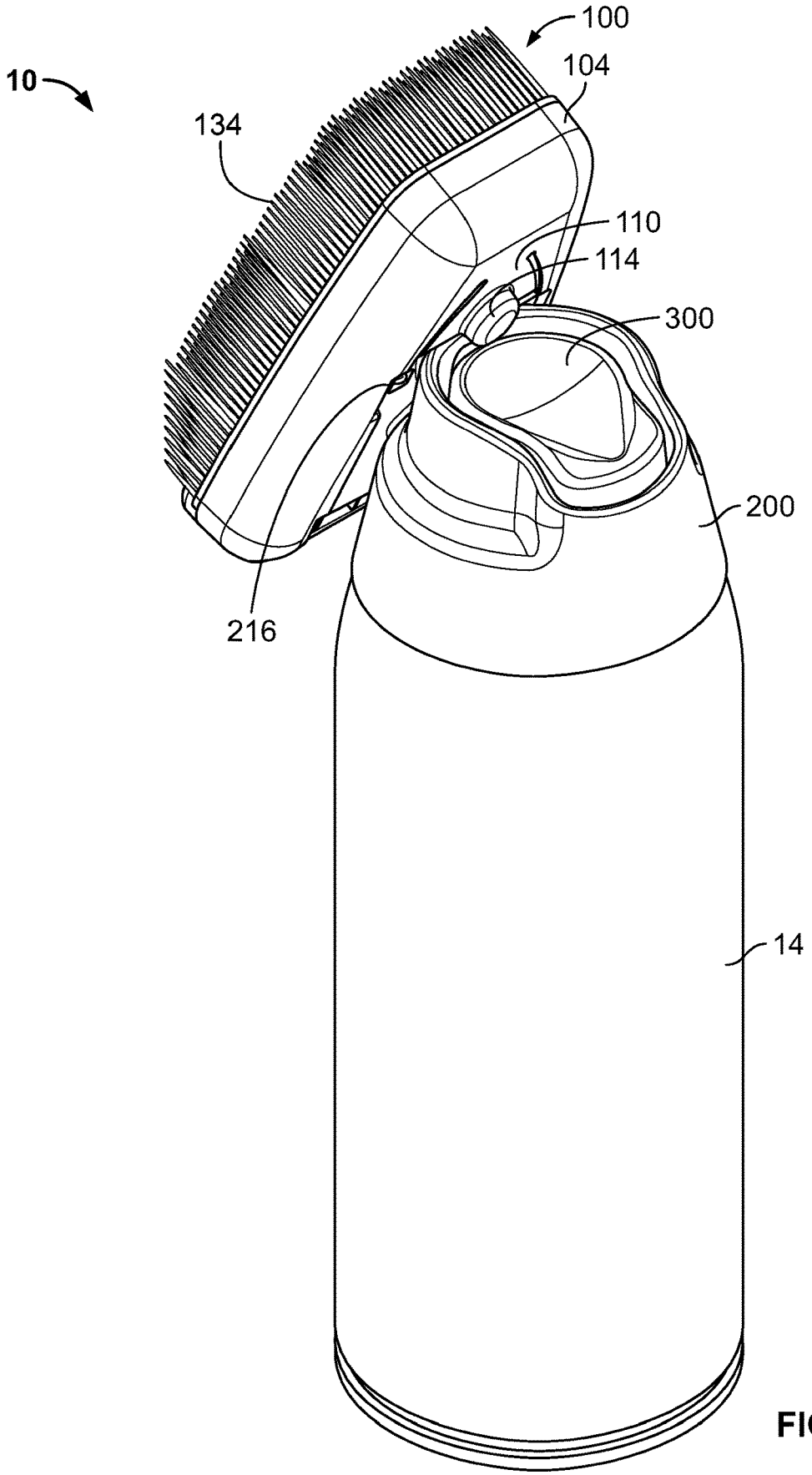
FIG. 2 is a rear perspective view of the spray cap system of FIG. 1.
Figure 3:
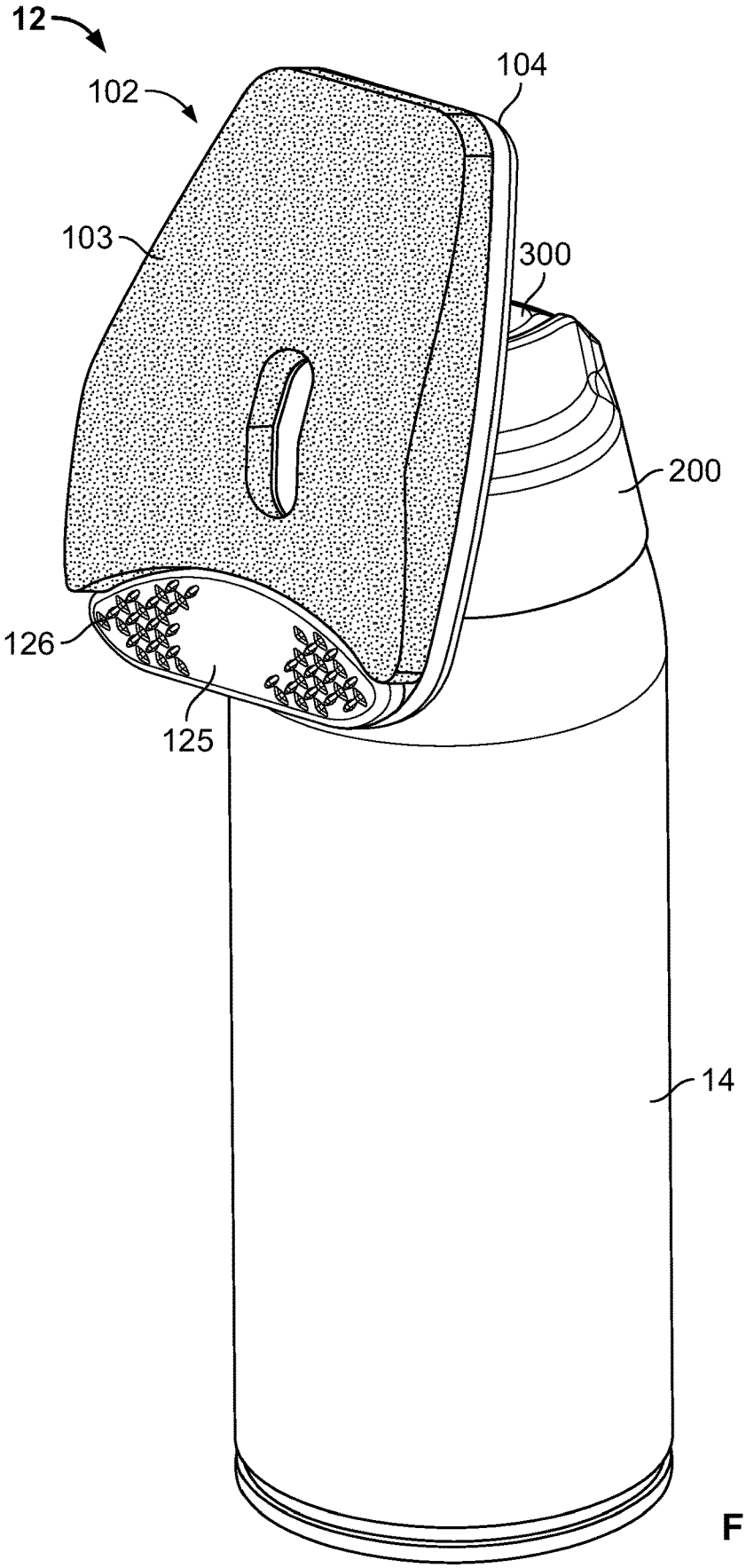
FIG. 3 is a front perspective view of an embodiment of an assembled spray cap system including an optional foam pad applicator, shown installed on a representative can.
Figure 3A:
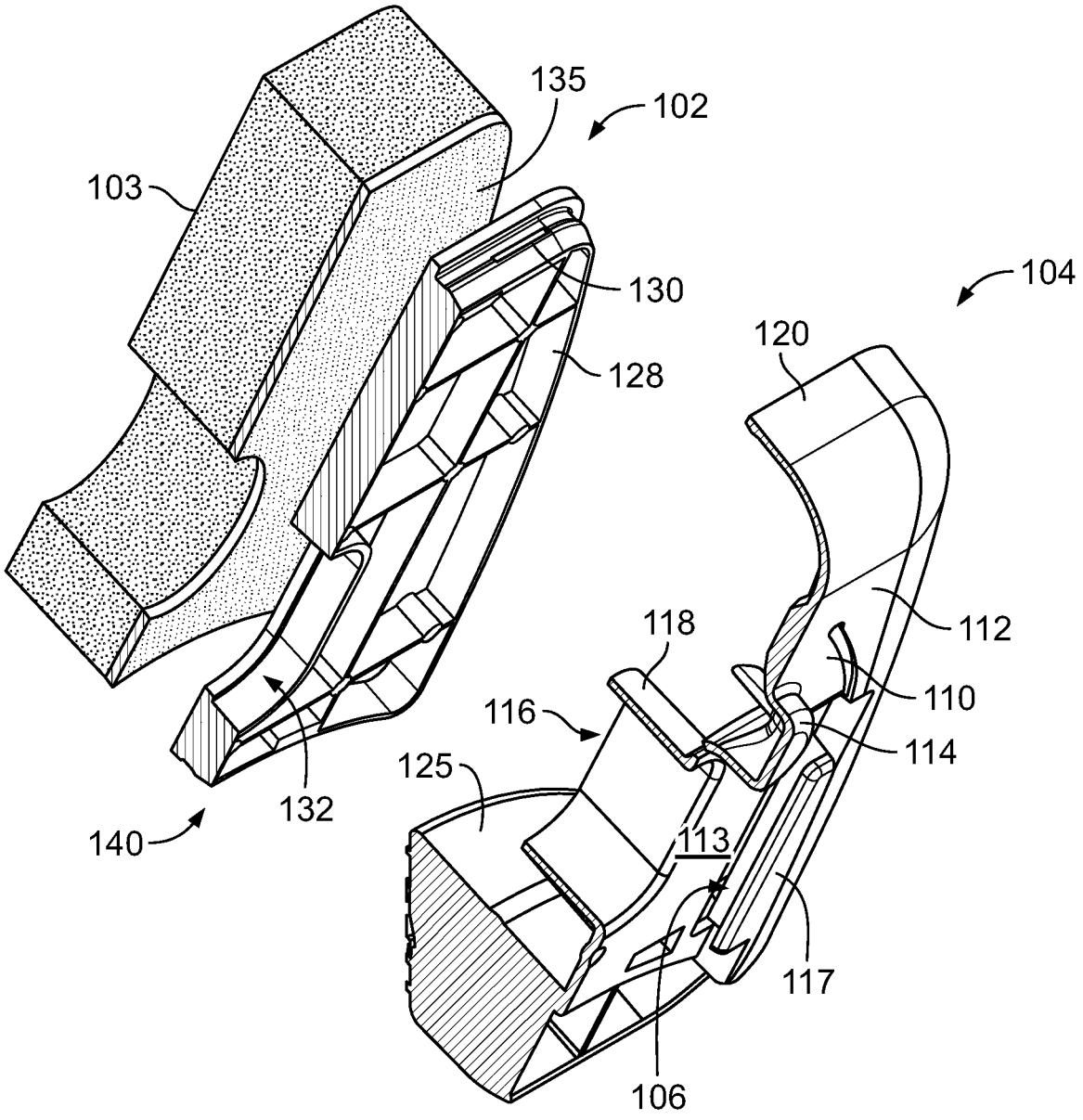
FIG. 3A is an exploded cross-sectional perspective view of the spray cap system of FIG. 3 having a different, optional foam pad applicator or sponge shown mounted to a separate backplane or adapter, without the can.
Figure 4:
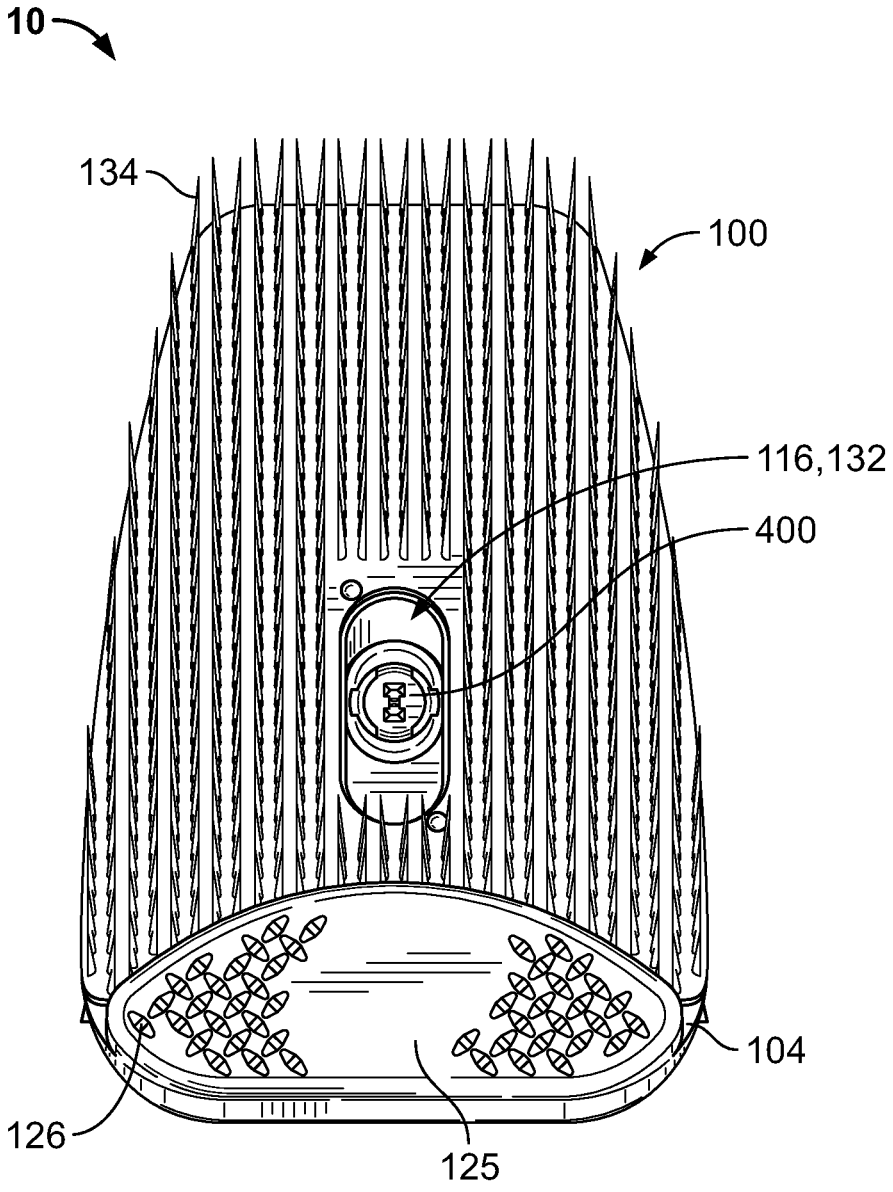
FIG. 4 is a front view of the spray cap system of FIG. 1 without the can.
Figure 5:
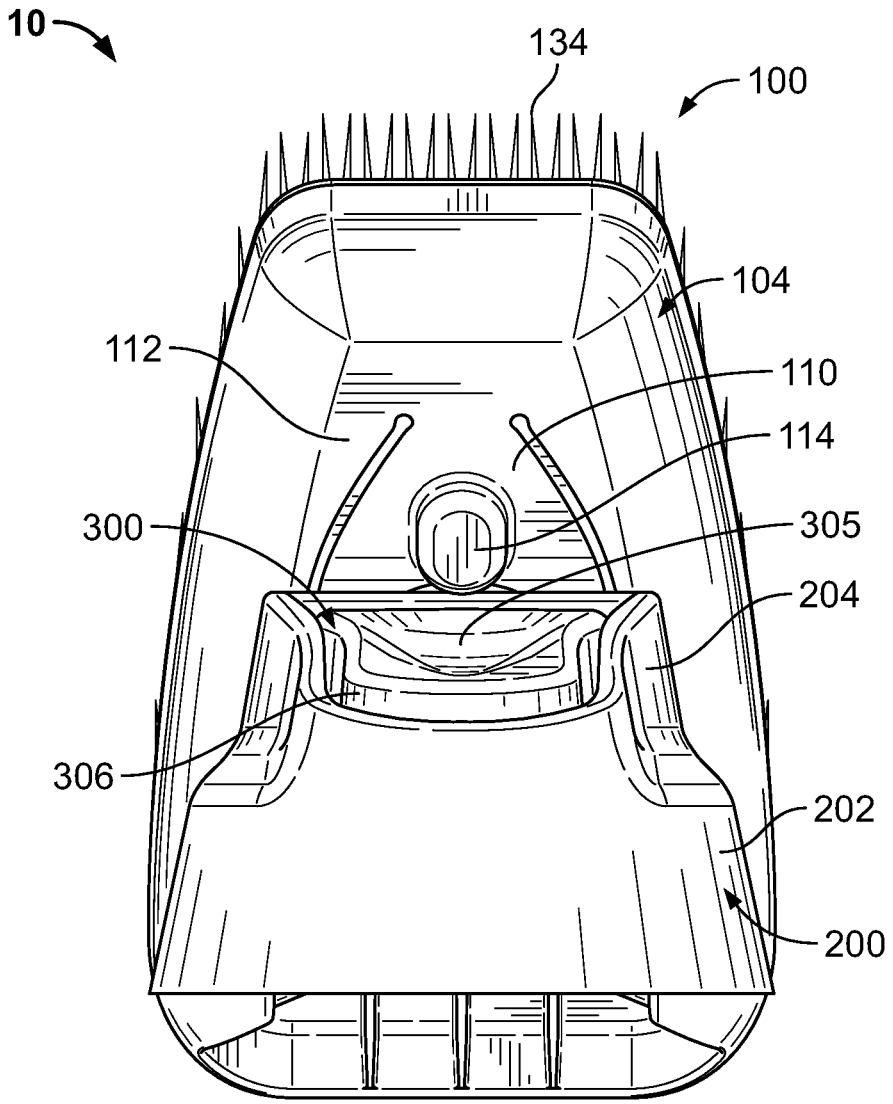
FIG. 5 is a rear view of the spray cap system of FIG. 1 without the can.
Figure 9:
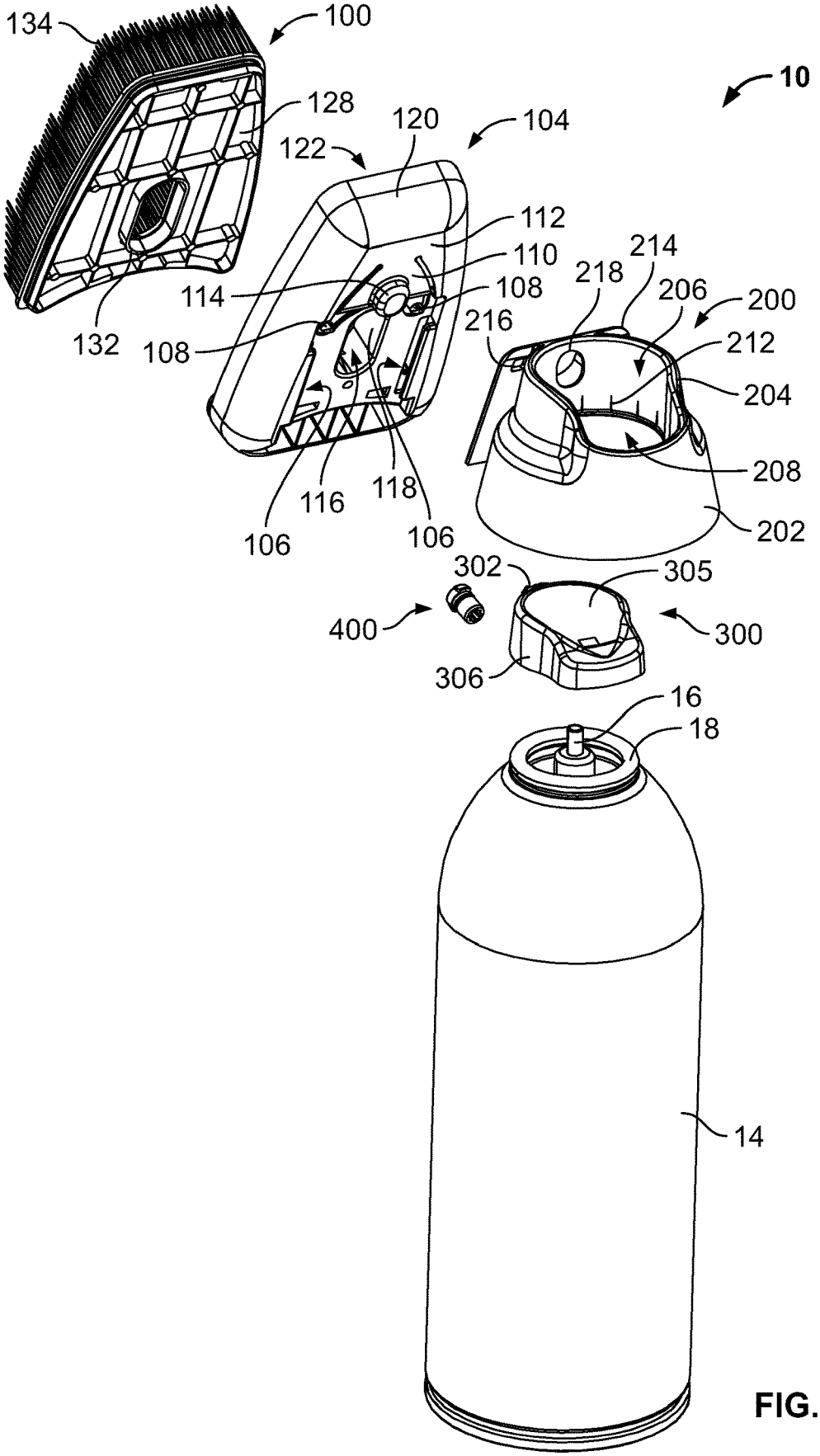
FIG. 9 is an exploded rear perspective view of the spray cap system of FIG. 1.
Figure 10:
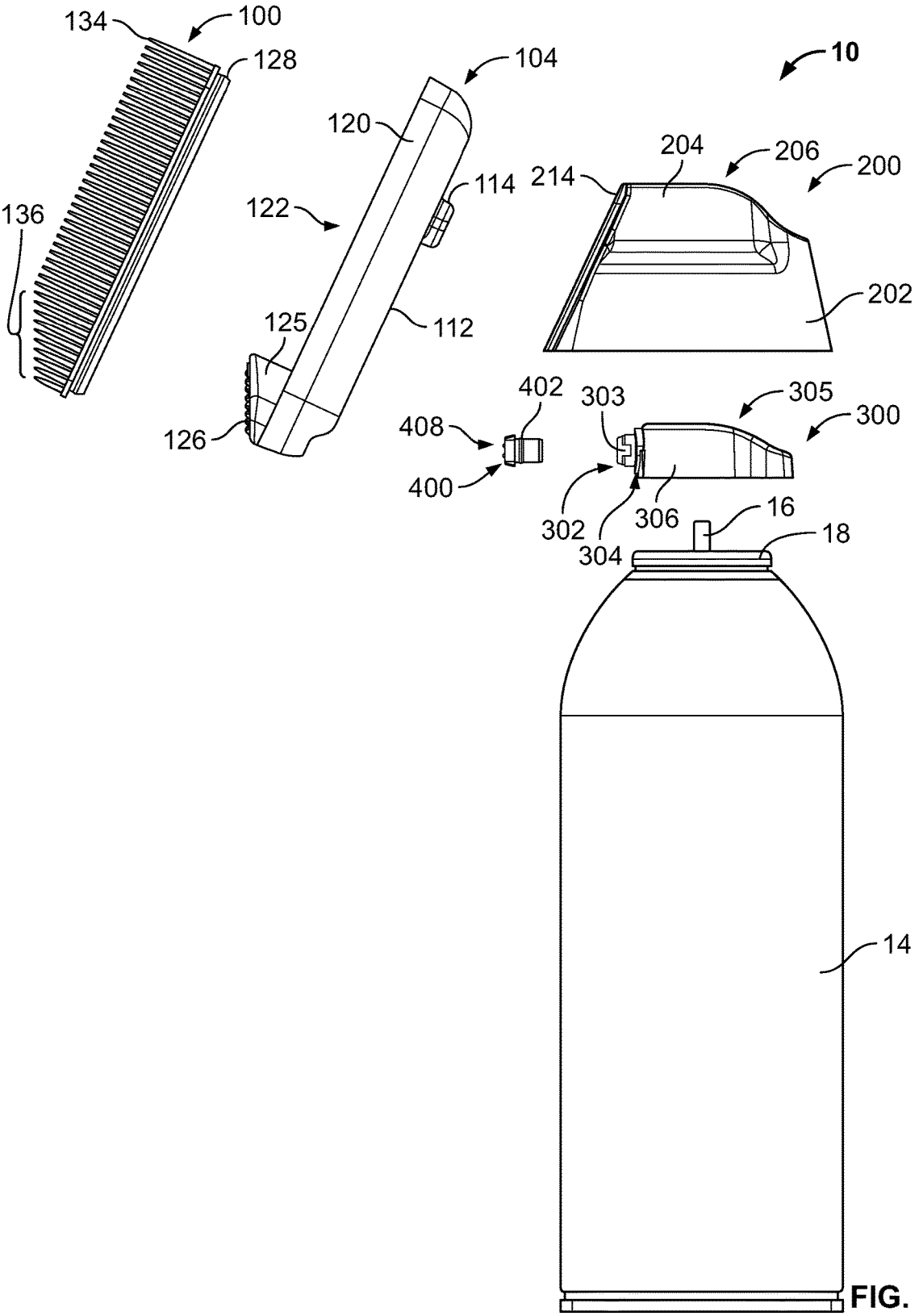
FIG. 10 is an exploded side view of the spray cap system of FIG. 1.
Figure 11:
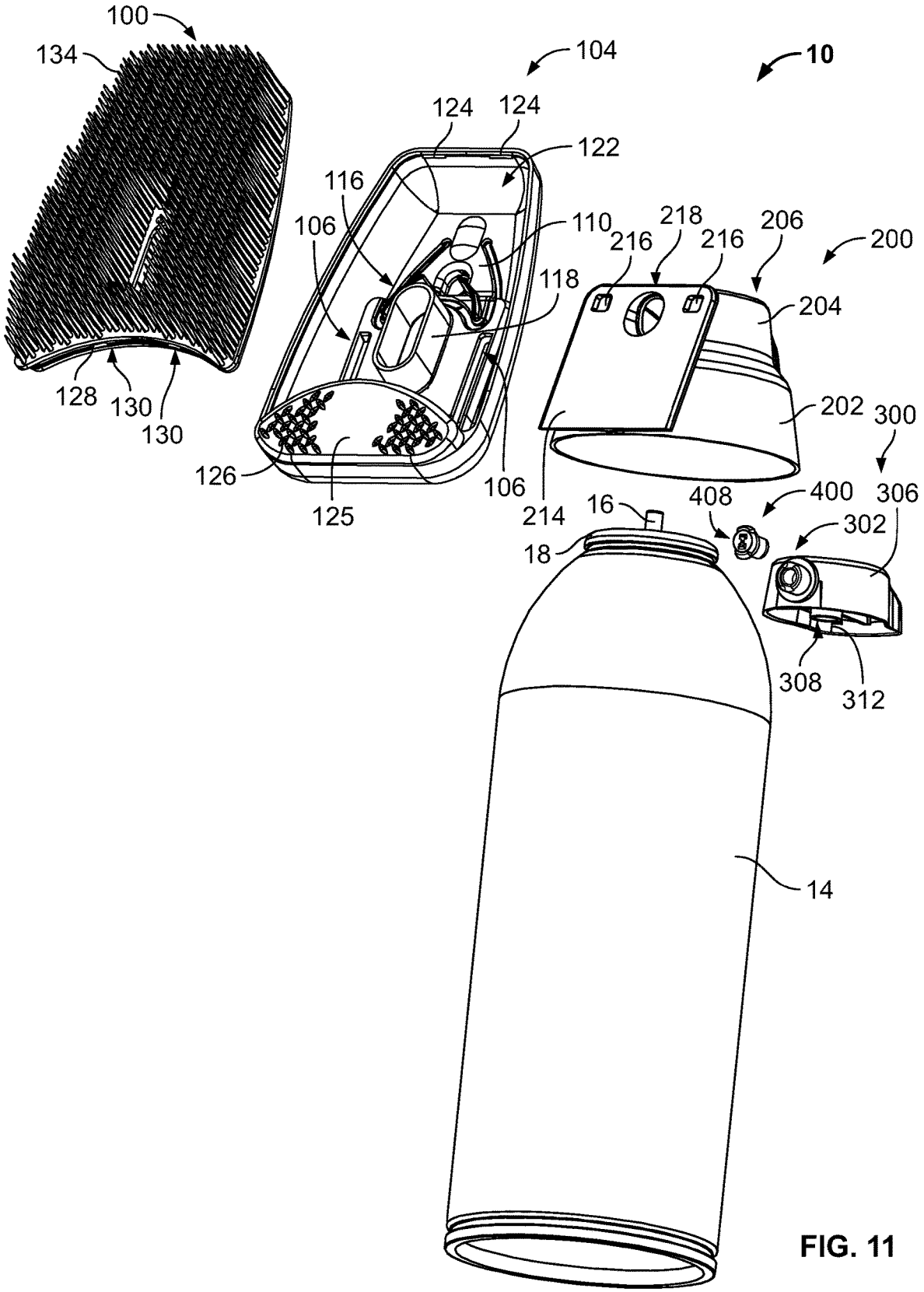
FIG. 11 is an exploded front perspective view of the spray cap system of FIG. 1.

FIGS. 1-2 show an exemplary spray cap system 10 including a brush 100, as installed on a representative can 14. FIG. 3 shows an exemplary spray cap system 12 including a foam pad applicator 102 having a foam pad 103, as installed on a representative can 14. The spray cap systems 10, 12 may also include a spray cap 200 that is attachable to the top of the can 14, a spray button 300 movably arranged relative to the spray cap 200 and connectable to a valve stem 16 of the can 14, and a spray nozzle 400 positioned on a discharge end of the spray button 300. The can 14 may be composed of two or three pieces, and include a valve stem 16 from which the contents of the can 14 may be dispensed, as shown in FIGS. 9-11. The spray cap systems 10, 12 differ in the implement that is removably attachable to an implement holder 104, i.e., the brush 100 and the foam pad applicator 102, respectively, but otherwise include the same components, as described in more detail below. In some embodiments, the brush 100, foam pad applicator 102, or alternative implement may be secured, e.g., glued, to an implement backplane 128, 140, which may be secured to, e.g., snapped into, the implement holder 104. For example, a foam pad 103 of the foam pad applicator 102 may be secured to an implement backplane 140 using glue 135, as shown in FIG. 3A. In some embodiments, the implement may be secured to a substrate, which may be secured to backplane 140.

At least some of the components of the spray cap systems 10, 12 may be formed of a polymer resin, such as polypropylene, high density polyethylene (HDPE), medium density polyethylene (MDPE), low density polyethylene (LDPE), or any combination thereof. For example, spray cap 200, spray tip nozzle 400, spray button 300 and brush 100 may be made from any of these polymers. The foam pad 103 (and other types of alternative implements) may be formed of a foam, a sponge material, a microfiber material, or other suitable materials. In some embodiments, each of the components of the spray cap systems 10, 12 may be made from the same materials. In other embodiments, one of more components of the spray cap system 10, 12 may be made from a different material than other components and thus may have different properties than the other components.

The components of the spray cap systems 10, 12 may be formed using an injection molded process, for example. In some embodiments, certain components may have characteristics that are different from the other components formed of resin. For example, the brush 100 and bristles 134 may each be formed of polypropylene but have different characteristics for purposes of being more pliable and soft, as compared to the other components formed of a polypropylene resin. As another example, the brush 100 may be formed of LDPE or HDPE to obtain particular desired properties.

Various components of the spray cap systems 10, 12 may have different physical characteristics. For example, the components could be different colors for aesthetic reasons. As another example, the spray button 300 may have improved sealing properties in order for the spray button 300 to interface with the valve stem 16 of the can 14 without leaking. As a further example, the spray cap 200 may be rigid to ensure that the spray cap 200 cannot be easily detached from the can 14 and to ensure that the implement holder 104 can be removably attached and detached from the spray cap 200 without breaking and without causing the spray cap 200 to detach from the can 14.

FIGS. 4-13 show additional assembled, exploded, and cross-sectional views of the spray cap system 10 with and without the can 14. FIGS. 14-19 show views of the spray cap 200, the spray button 300, and the spray nozzle 400 assembled together and without the implement holder 104. The spray cap 200 may be adapted to fit over and cover a top portion of the can 14. In particular, a skirt 202 may be arranged on a lower portion of the spray cap 200. The skirt 202 may be generally cylindrical and tapered, and adapted to fit over and cover the top portion of a can 14. The skirt 202 may be tapered upwardly and inwardly relative to the top of the can 14. A sidewall 204 extending upwardly from the skirt 202 may form a recessed area 206. In some embodiments, the sidewall 204 may be indented relative to the skirt 202 to form the recessed area 206, as shown in the figures. In other embodiments, other suitable shapes of the recessed area 206 may be formed by the sidewall 204.

Figure 13:
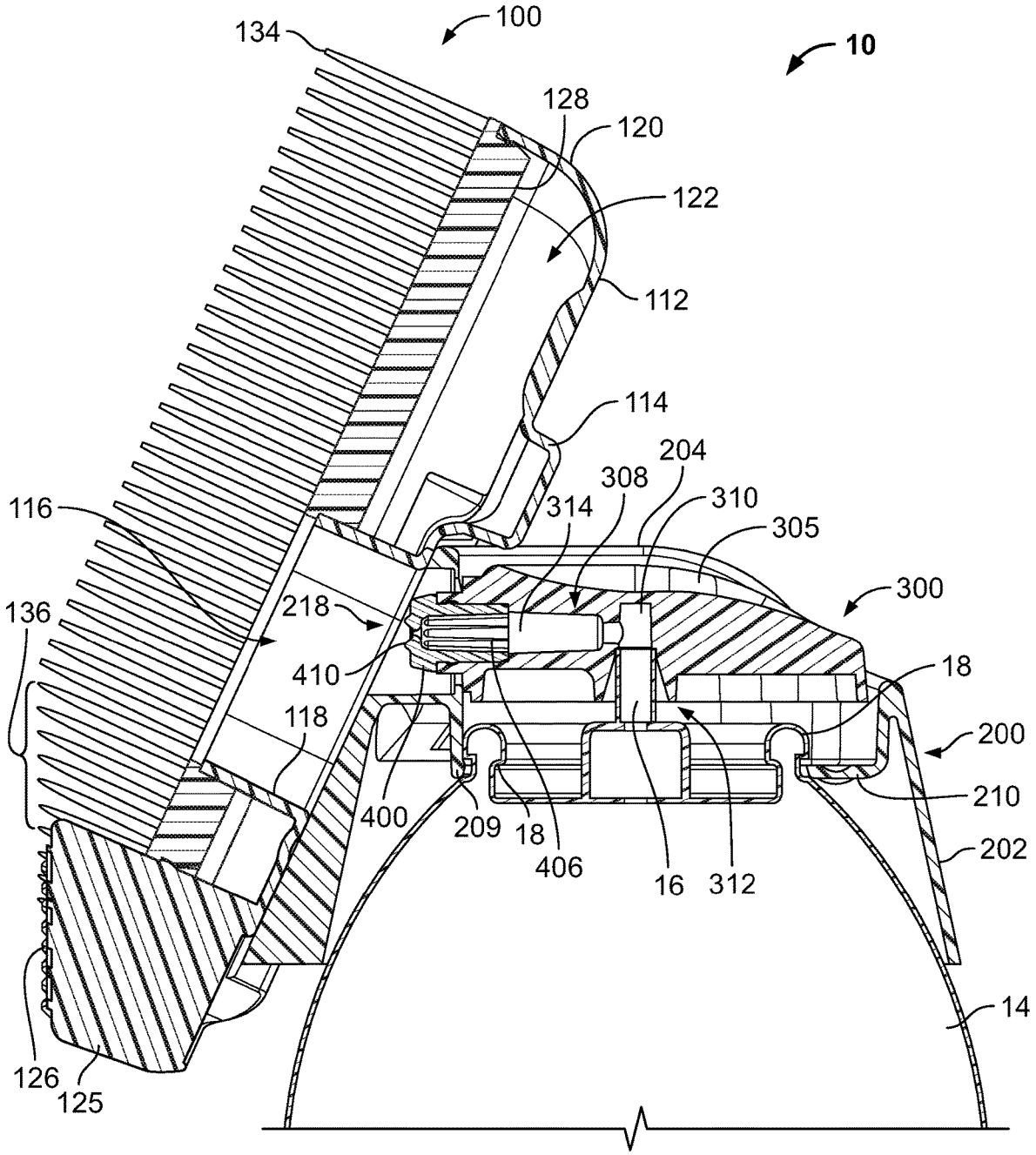
FIG. 13 is a side cross-sectional view of the spray cap system of FIG. 1.
Figure 14:
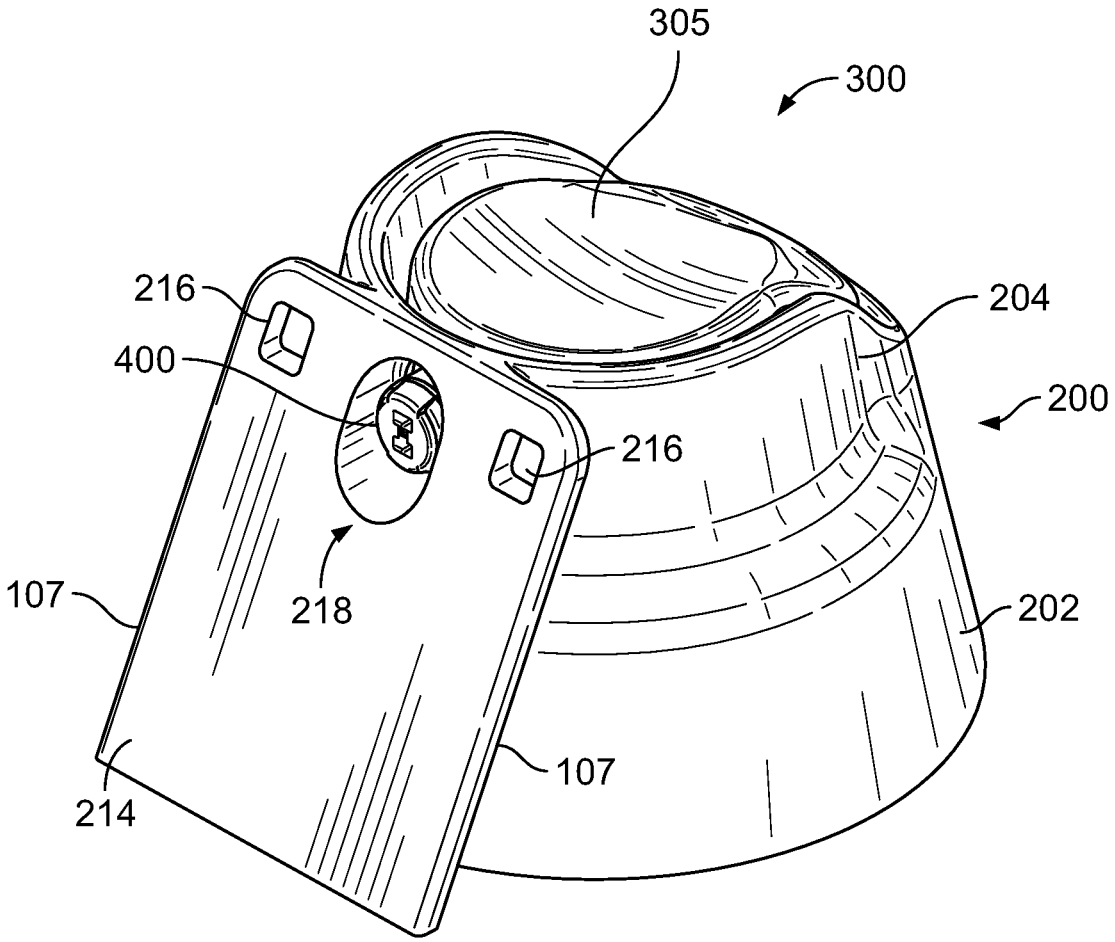
FIG. 14 is a perspective view of an embodiment of a spray cap, a spray button, and a spray nozzle assembled together.
Figure 15:
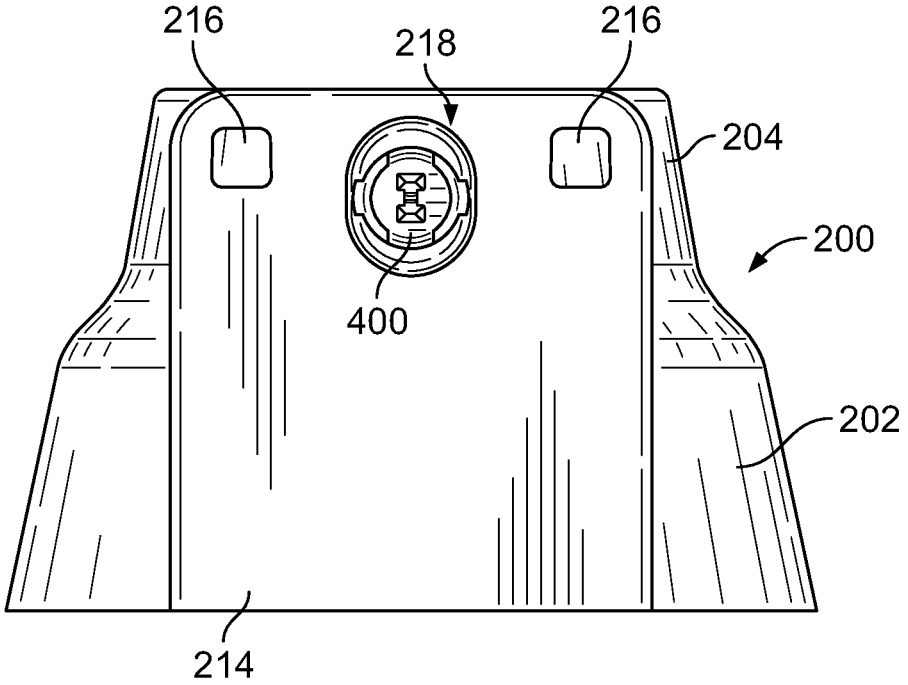
FIG. 15 is a front view of the spray cap, the spray button, and the spray nozzle of FIG. 14.
Figure 16:
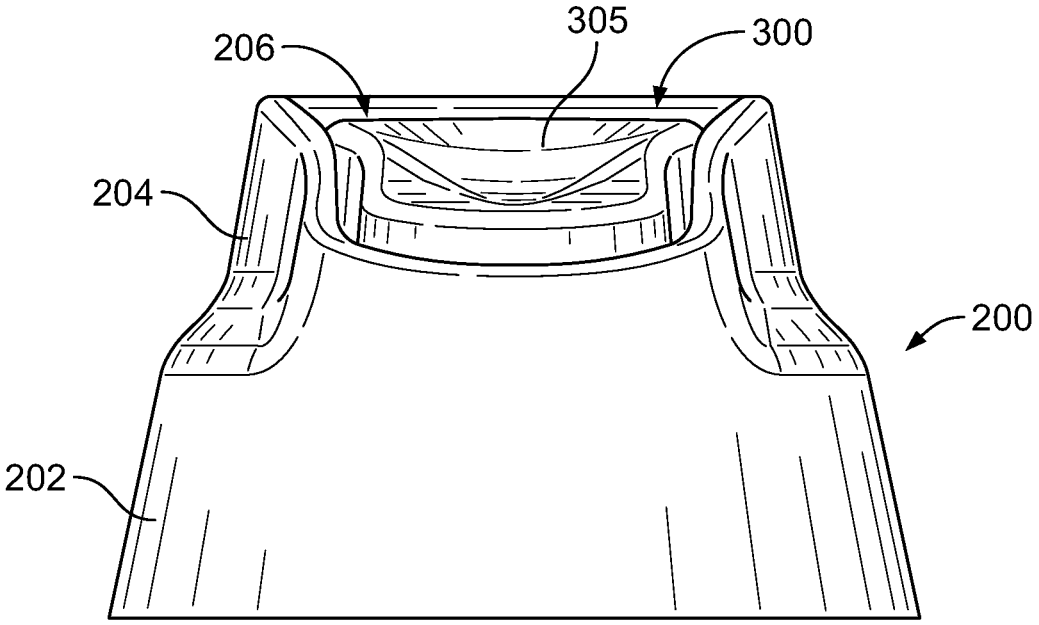
FIG. 16 is a rear view of the spray cap, the spray button, and the spray nozzle of FIG. 14.
Figure 17:
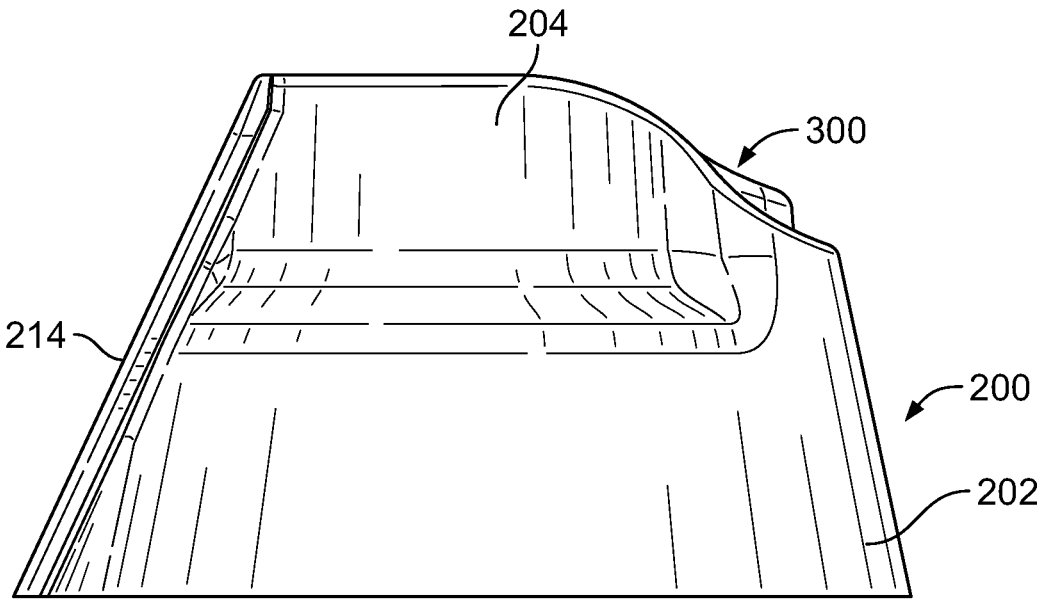
FIG. 17 is a side view of the spray cap, the spray button, and the spray nozzle of FIG. 14.
Figure 18:
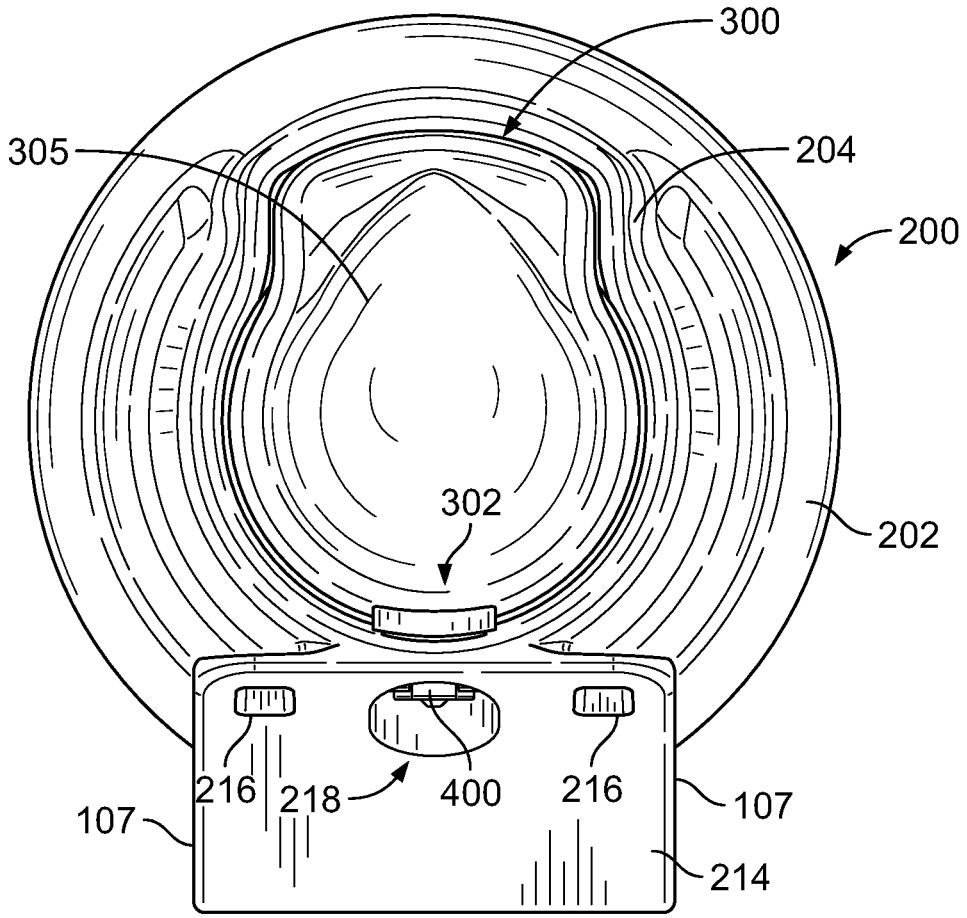
FIG. 18 is a top view of the spray cap, the spray button, and the spray nozzle of FIG. 14.
Figure 19:
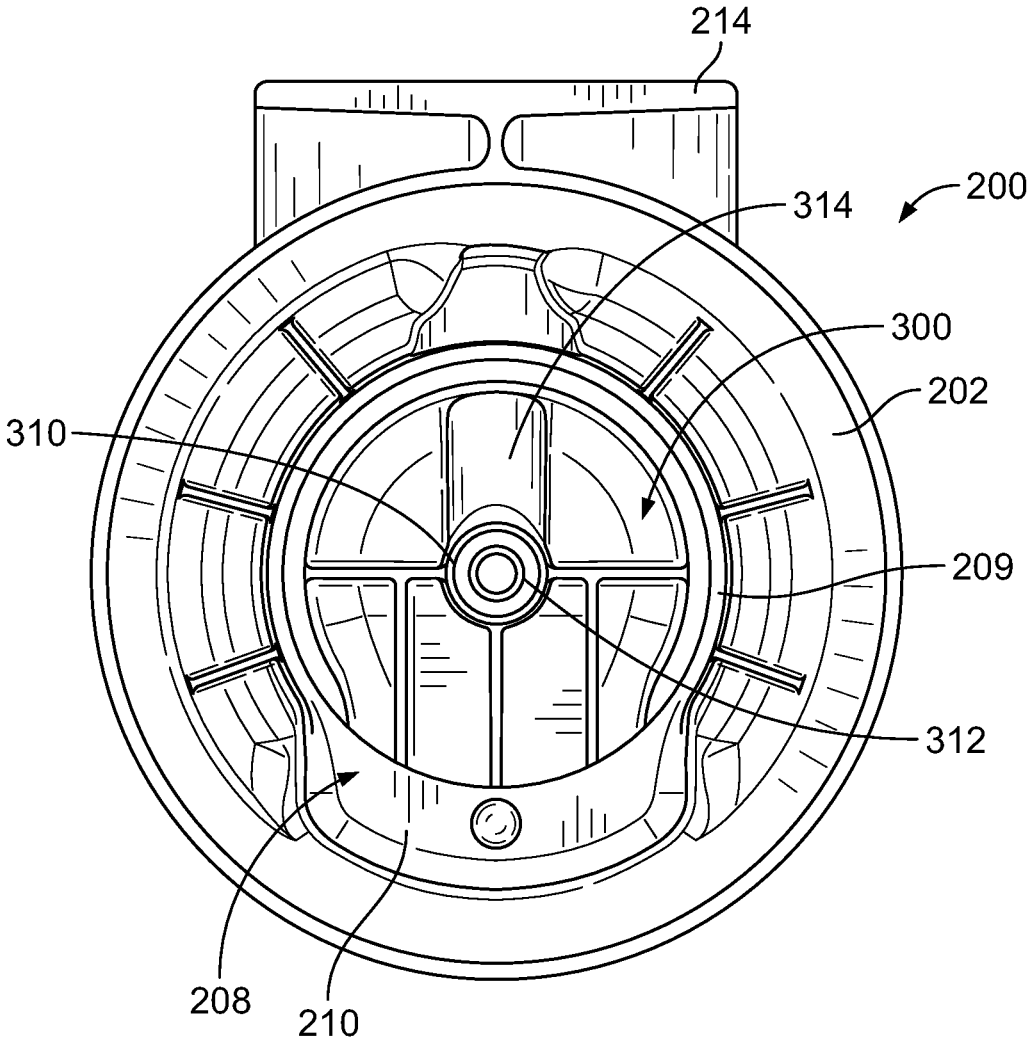
FIG. 19 is a bottom view of the spray cap, the spray button, and the spray nozzle of FIG. 14.
Figure 20:
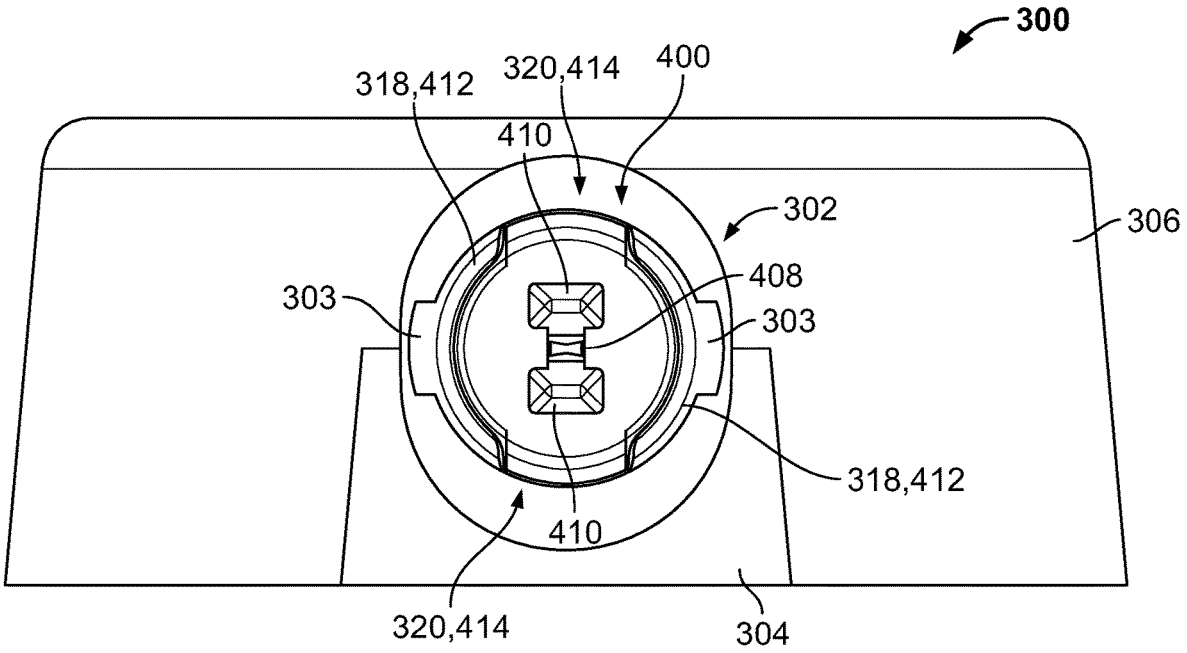
FIG. 20 is a front view of an embodiment of a spray button and a spray nozzle assembled together.
Figure 21:
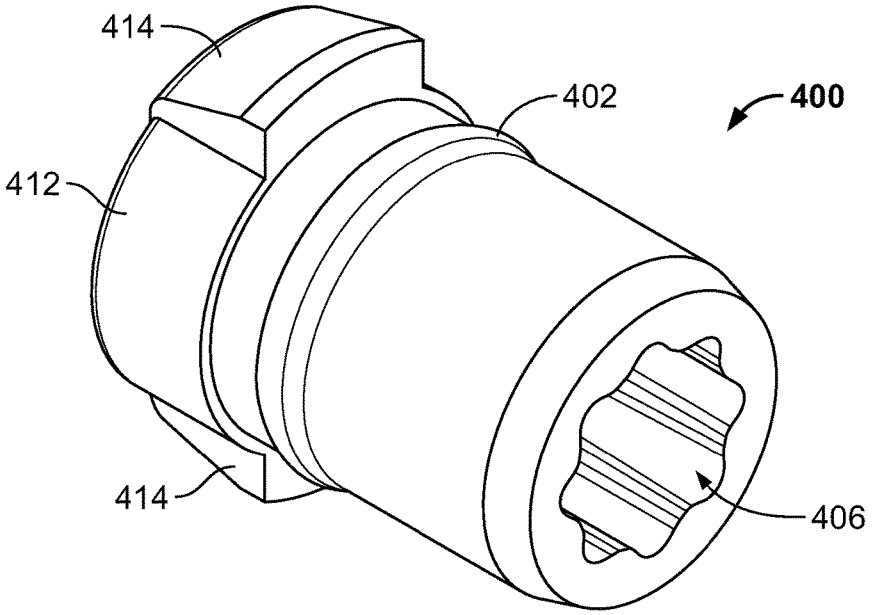
FIG. 21 is a rear perspective view of an embodiment of a spray nozzle.
Figure 22:
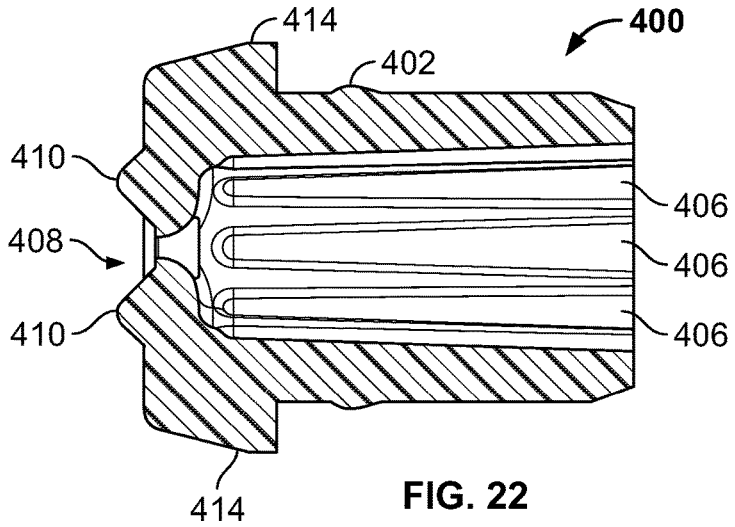
FIG. 22 is a side cross-sectional view of the spray nozzle of FIG. 21.
Figure 23:
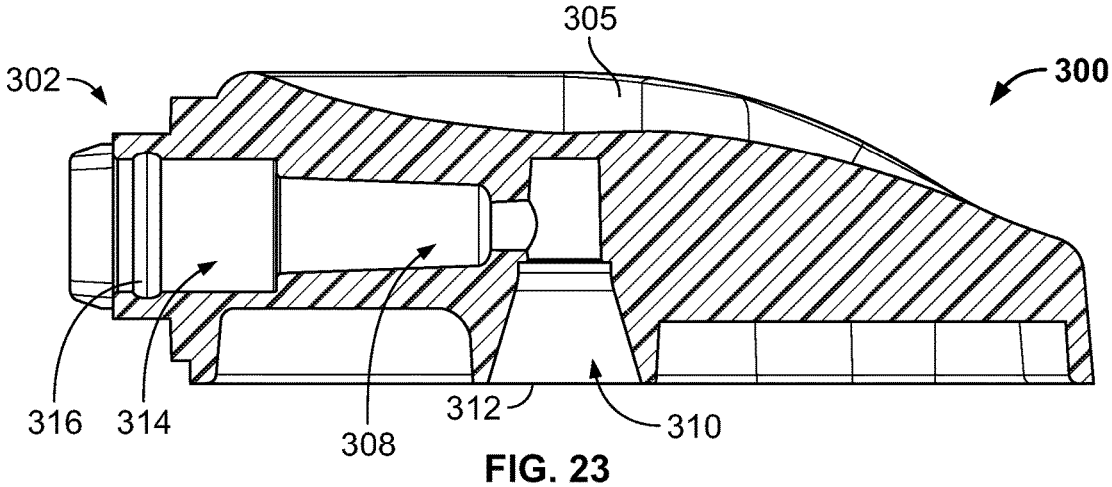
FIG. 23 is a side cross-sectional view of an embodiment of a spray button.
Figure 24:
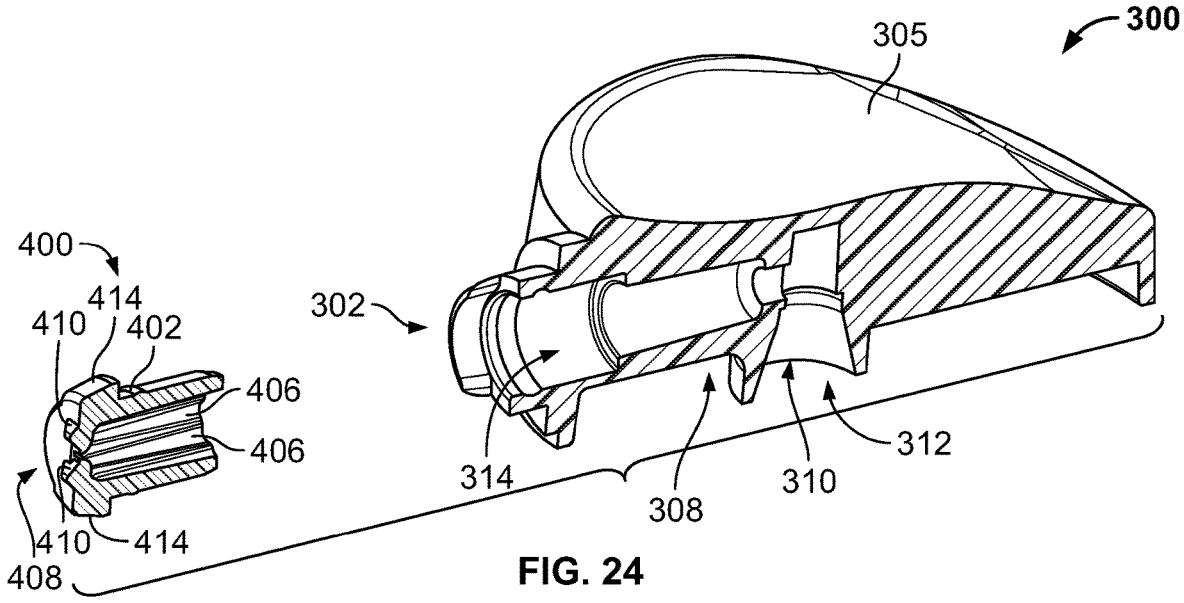
FIG. 24 is an exploded cross-sectional perspective view of an embodiment of a spray button and a spray nozzle.
Figure 25:
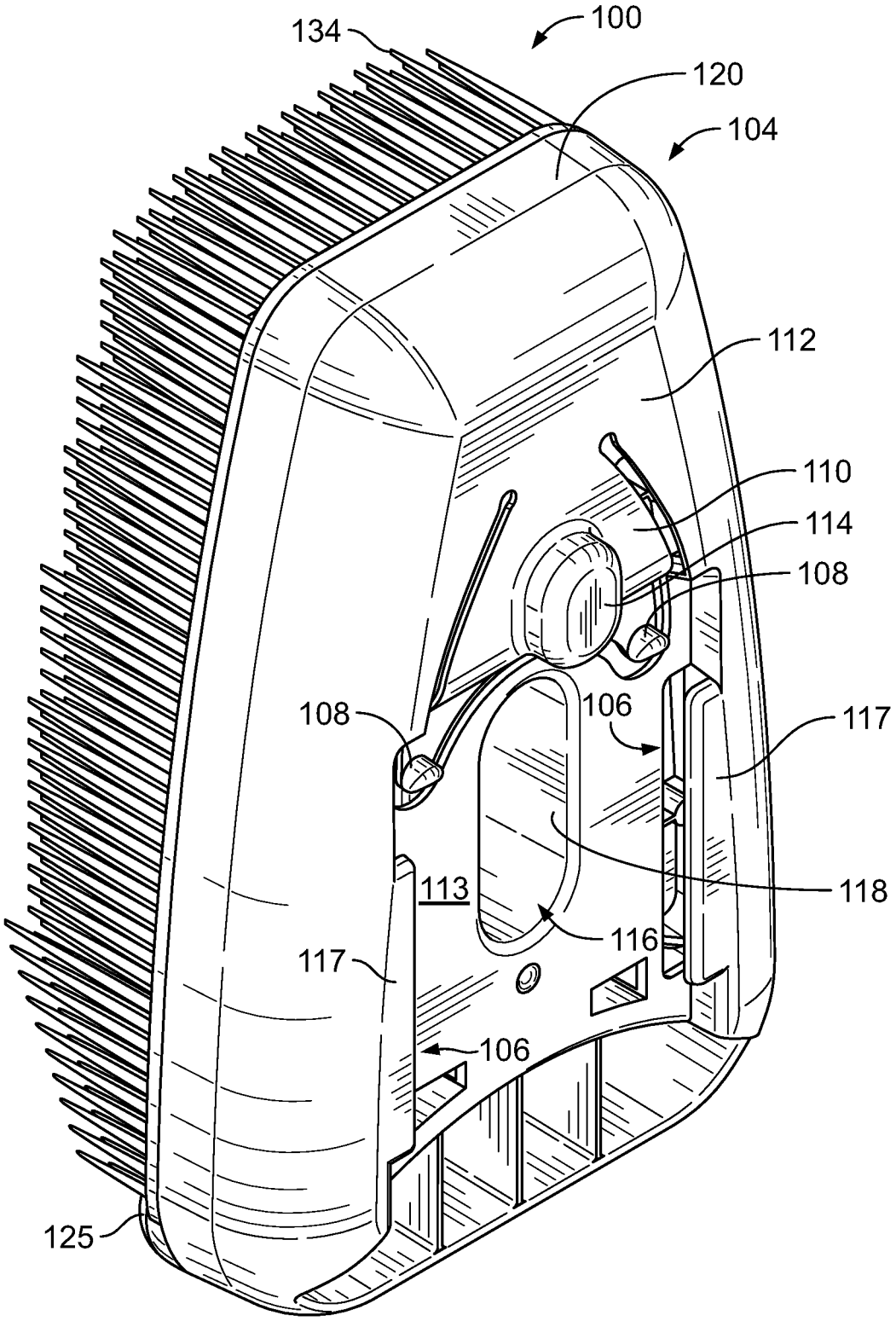
FIG. 25 is a rear perspective view of an embodiment of a brush holder and a brush assembled together.
Figure 26:
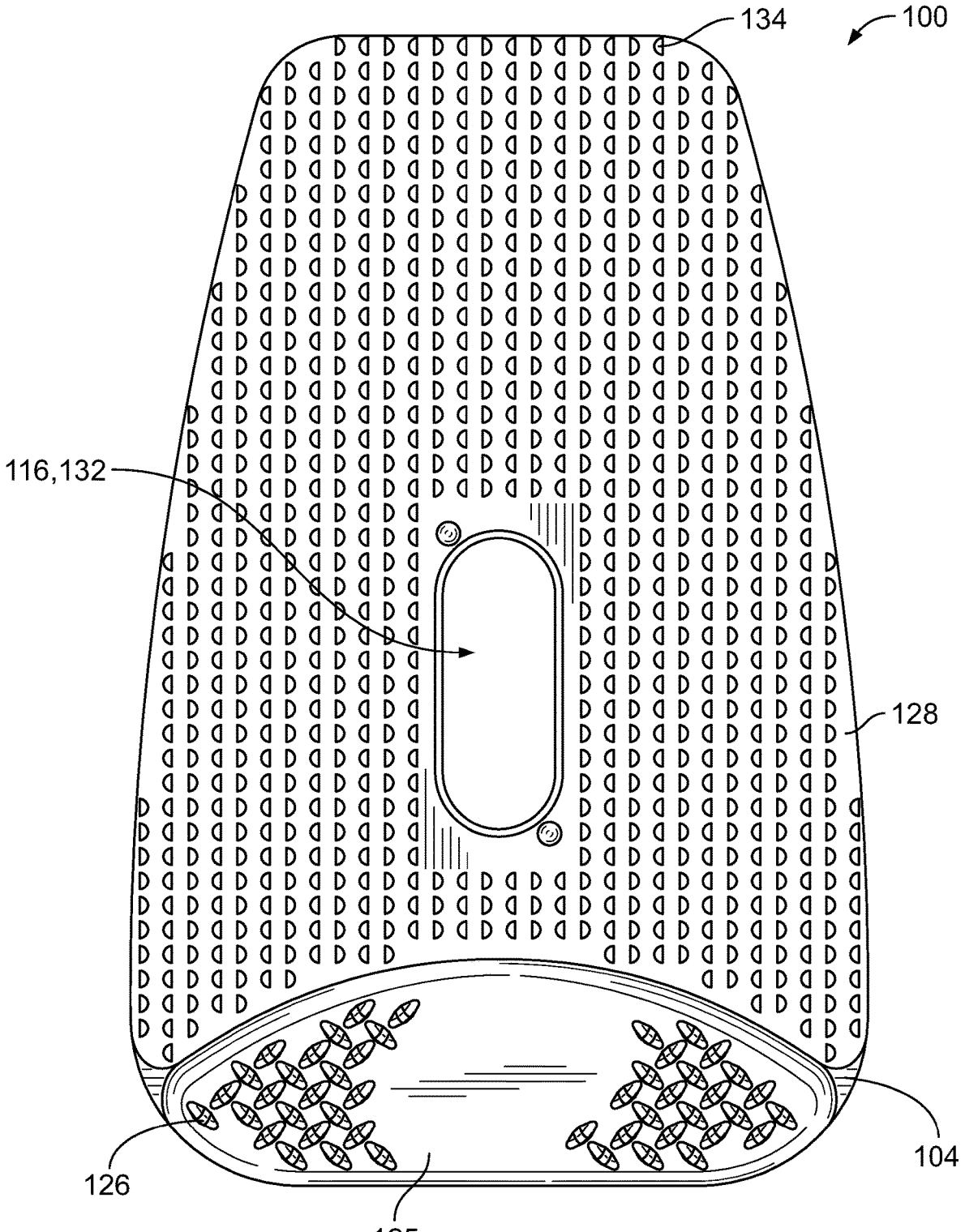
FIG. 26 is a front view of the brush holder and the brush of FIG. 25.
Figure 27:
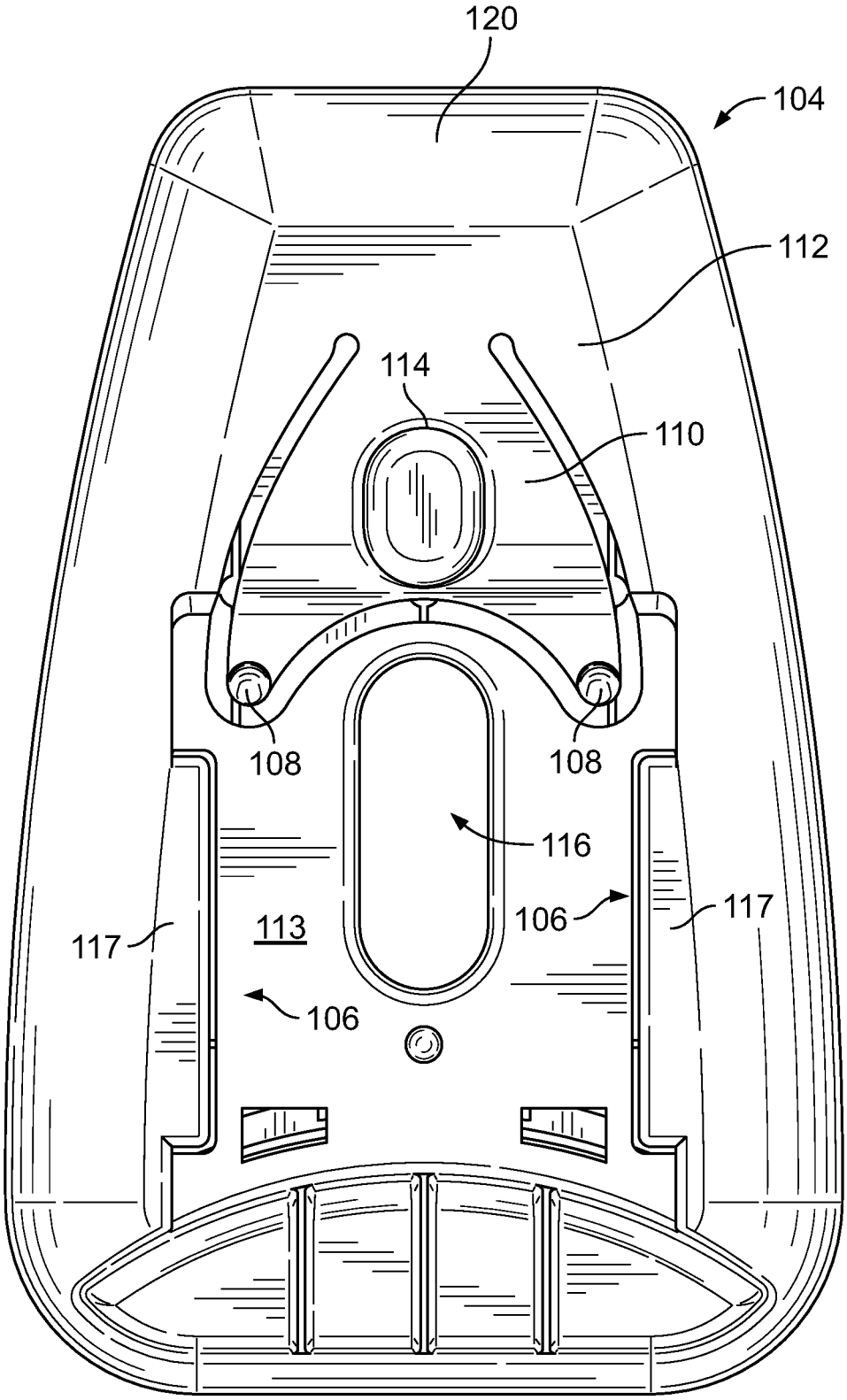
FIG. 27 is a rear view of the brush holder and the brush of FIG. 25.

The spray button 300 may be disposed in the recessed area 206 of the spray cap 200. The outer perimeter and/or profile of spray button 300 may have a shape generally corresponding to the recessed area 206, but may be slightly smaller than the recessed area 206 such that the spray button 300 is movable relative to the recessed area 206 without touching the sidewall 204. The recessed area 206 may have a generally circular aperture 208 with a lip 209 that can attach to a rim 18 of the can 14, as best shown in FIG. 13. In addition, the recessed area 206 may include a generally planar shelf 210 at a rear portion of the spray cap 200. The shelf 210 may extend laterally and/or inwardly from an inner surface of the sidewall 204. The lip 209 and the shelf 210 may snap fit onto the rim 18 such that the spray cap 200 is attached to the can 14. In particular, the lip 209 and the shelf 210 may horizontally interface with the can 14 underneath the rim 18 so that the spray cap 200 is secured to the can 14. The shelf 210, in conjunction with the lip 209, may allow for continuous fit with the rim 18 of the can 14 while still allowing the spray button 300 to move when depressed by a user.

Figure 12:
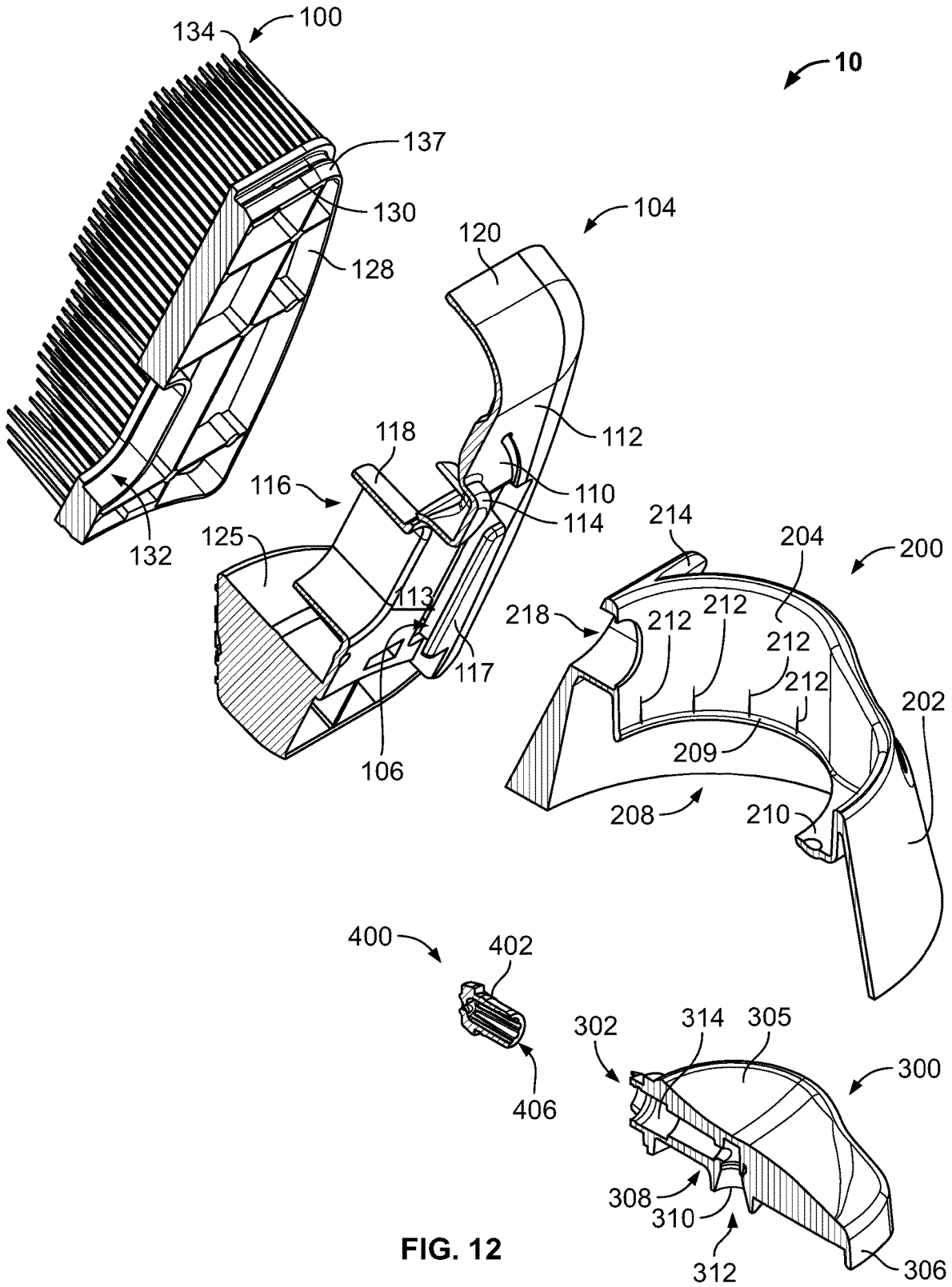
FIG. 12 is an exploded cross-sectional perspective view of the spray cap system of FIG. 1 without the can.

The inner surface of the recessed area 206 may also include one or more protrusions 212, as best shown in FIGS. 9 and 12. The protrusions 212 may be formed on the inner surface of the sidewall 204. When the spray cap 200 is installed on the can 14, the protrusions 212 may restrict the rotation of the spray cap 200 on the can 14 by creating a tighter frictional fit with the rim 18 of the can 14. In particular, the protrusions 212 may cause a radial compression and interference fit of the spray cap 200 with the can 14. Furthermore, the protrusions 212 may radially center the spray can 200 on the can 14.

The spray cap 200 may further include a plate 214 that is formed on an outer surface of the sidewall 204. The plate 214 may be substantially flat and be adapted to engage with the implement holder 104. The side edges 107 of the plate 214 may mate with corresponding receiving slots 106 of the implement holder 104. In particular, the implement holder 104 may attach to the plate 214 by sliding the receiving slots 106 onto the side edges 107 of the plate 214. The plate 214 may further include mating apertures 216 for engaging with and locking the implement holder 104 into place. The mating apertures 216 may mate with corresponding locking protrusions 108 of the implement holder 104. The locking protrusions 108 may be on an end of a flexible cantilevered hinge 110 of the implement holder 104. While the implement holder 104 slides onto the plate 214, the surface of the plate 214 may deflect the hinge 110 and the locking protrusions 108. When the locking protrusions 108 reach the mating apertures 216, the locking protrusions 108 can snap into the mating apertures 216. The mating of the locking protrusions 108 into the mating apertures 216 may ensure that the implement holder 104 is secured to the spray cap 200. To remove the implement holder 104 from the spray cap 200, the hinge 110 may be depressed so that the locking protrusions 108 are released from the mating apertures 216. The user may then slide the implement holder 104 off of the plate 214.

A nozzle opening 218 may be formed through the sidewall 204 and the plate 214 of the spray cap 200. A nozzle receiver 302 (of the spray button 300) and the spray nozzle 400 may be positioned in the nozzle opening 218. The nozzle opening 218 may be generally oblong or another suitable shape. When assembling the spray button 300 with the spray cap 200, a keyed locking structure, including engagement protrusions 303 and positioning ramp 304, on the nozzle receiver 302 may be engaged to the nozzle opening 218. In particular, the nozzle receiver 302 with spray nozzle 400 mounted thereto may be inserted into the nozzle opening 218 with the spray button 300 oriented vertically, then the spray button 300 may be rotated to be oriented horizontally and positioned in the recessed area 206 of the spray cap 200. During the rotation of the spray button 300 during assembly, the engagement protrusions 303 may engage with the nozzle opening 218 such that the nozzle receiver 302 (and the spray button 300) is retained in the nozzle opening 218. The centering ramp 304 may abut an inner surface of the spray cap 200 so that the spray button 300 is centered over the can 14. After installation, the spray button 300 may be cantilevered from the nozzle receiver 302 so that the spray button 300 can be depressed.

As described above, the spray button 300 may sit and be movable in the recessed area 206 of the spray cap 200. In some embodiments, the spray button 300 may have a generally concave top surface 305. A concave top surface 305 may assist a user in placing their finger on the spray button 300, and also keep the finger of the user in place while depressing the spray button 300. In other embodiments, the top surface 305 of the spray button 300 may be convex or flat. A side wall 306 of the spray button 300 may extend downwardly from the top surface 305. The nozzle receiver 302 described previously may be disposed on an outer surface of the side wall 306.

The spray button 300 may also interface with the valve stem 16 of the can 14 via a flow chamber 308. The flow chamber 308 may be arranged on the underside of the spray button 300 for a 90 degree spray discharge, and include two portions arranged perpendicularly relative to each other for conveying the contents of the can 14, as best shown in FIGS. 8, 12, 13, 19, 23, and 24. The valve stem 16 of the can 14 and the spray nozzle 400 may therefore also be arranged perpendicularly relative to each other. A first portion 310 of the flow chamber 308 may be arranged vertically within the spray button 300 and have an end 312 adapted to interface with the valve stem 16 of the can 14. In particular, the first portion 310 may have a generically conical shape, where the end 312 has a diameter greater than the remainder of the first portion 310. During assembly of the spray cap system 10, the valve stem 16 of the can 14 may be positioned within the end 312. The end 312 may press fit with the valve stem 16 when the spray button 300 is initially depressed by a user so that the valve stem 16 is optimally sealed to the flow chamber 308, as best shown in FIG. 13. In some embodiments, an upper portion of the first portion 310 may end higher than a second portion 314 (described below) to allow for fluid expansion before discharge, and to ease manufacture of the spray button 300.

A second portion 314 of the flow chamber 308 may be arranged horizontally within the spray button 300 and be connected to and substantially perpendicular to the first portion 310. The second portion 314 may extend from the first portion 310 to the nozzle receiver 302. In some embodiments, the second portion 314 may be comprised of several differently sized cylindrical shapes to more optimally convey and guide the contents of the can 14 as it is dispensed by reducing turbulence as the fluid begins to compress as it moves towards the orifice 408. The differently sized cylindrical shapes of the second portion 314 may also allow for more optimal molding of the flow chamber 308. In some embodiments, the flow chamber 308 may have a single portion that is arranged inline with the valve stem 16, e.g., at a zero degree orientation.

The spray nozzle 400 may be engaged to the spray button 300, and in particular, to the nozzle receiver 302 so as to communicate with the flow chamber 308. To ensure that the spray nozzle 400 is retained by the spray button 300, a retaining element 316 may be disposed circumferentially on an inner surface of the second portion 314 of the flow chamber 308. The retaining element 316 may be a groove on the inner surface of the second portion 314, and may be adapted to interface with a corresponding locking detent 402 on an outer surface of the spray nozzle 400. The locking detent 402 may be circumferentially disposed on the outer surface of the spray nozzle 400. When the spray nozzle 400 is inserted into the flow chamber 308 during installation, the locking detent 402 may mate with the retaining element 316 such that the spray nozzle 400 is retained by the spray button 300. The retaining element 316 and the locking detent 402 may comprise any geometry to allow retained attachment thereof.

To ensure that the spray nozzle 400 is oriented correctly in the spray button 300, an orientation element, including a plurality of protrusions 318 and a plurality of recesses 320, may be disposed on an outer surface of the nozzle receiver 302. The protrusions 318 and the recesses 320 may be adapted to mate with a corresponding nozzle orientation element of the spray nozzle 400. The orientation element in conjunction with the nozzle orientation element may also prevent rotational movement of the spray nozzle 400 relative to the nozzle receiver 302. The protrusions 318 and the recesses 320 may be disposed circumferentially about the outer face of the nozzle receiver 302.

The nozzle orientation element of the spray nozzle 400 may include a plurality of corresponding recesses 412 and a plurality of corresponding protrusions 414 that are disposed circumferentially on an outer surface of the spray nozzle 400. The plurality of protrusions 318 of the spray button 300 may mate with the plurality of corresponding recesses 412 of the spray nozzle 400, and the plurality of recesses 320 of the spray button 300 may mate with the plurality of corresponding protrusions 414 of the spray nozzle 400.

The spray nozzle 400 may include several features to direct, convey, and guide the contents of the can 14 when dispensed. A chamber within the spray nozzle 400 may have a plurality of fluted inner walls 406, which may or may not be tapered from one end to an opposite end. The flow of the contents of the can 14 may be directed by laminar flow channels of the fluted inner walls 406 with less turbulence. In addition, the orifice 408 of the spray nozzle 400 may have a bowtie shape, a circular shape, or any other geometrical shape. Furthermore, protrusions 410 may be disposed on the outer face of the spray nozzle 400. In some embodiments, the protrusions 410 may have a trapezoidal shape and be positioned parallel to the orifice 408. In other embodiments, the protrusions 410 may be another shape and may be positioned at any circumferential position(s) about the orifice. As the contents of the can 14 are expelled through the orifice 408, the protrusions 410 may deflect and direct the expansion of the contents in a more controlled manner. Accordingly, the combination of the perpendicularly arranged flow chamber 308, the fluted inner walls 406, the bowtie-shaped orifice 408, and the protrusions 410 can ensure a more optimal flow and an enhanced spray pattern of the contents of the can 14 as it is discharged onto a surface. Furthermore, this combination negates the need for a flow rod, as is used in existing spray tips.

FIGS. 25-30 show views of an exemplary implement holder 104 and a brush 100 as assembled together. The implement holder 104 may have a generally trapezoidal shape with smooth, rounded contours for ergonomic gripping and handling by a user. In other embodiments, implement holder 104 may include any geometry or profile suitable for gripping and manipulation by a user. For example, the upper end of the implement holder 104 together with the attached implement may be more narrow than shown in the figures, or even generally pointed, to reach hard-to-reach locations on a surface.

The implement holder 104 may be removably attached to a plate 214 of the spray cap 200, as described above, using receiving slots 106 and locking protrusions 108. A backplane 112 of the implement holder 104 may include the receiving slots 106, the locking protrusions 108, and the hinge 110. In addition, a stop 114 may protrude from the hinge 110 of the backplane 112. The stop 114 may prevent the implement holder 104 from travelling too far on the plate 214 when a user is sliding the implement holder 104 onto the plate 214. The stop 114 may also act as a convenient place for a user to depress the hinge 110 when releasing the implement holder 104 from the plate 214.

The receiving slots 106 may be formed by a lower portion 113 of the backplane 112 and an outer wall 117. The lower portion 113 of the backplane 112 may be a recessed area of the backplane 112 such that the receiving slots 106 are formed between the lower portion 113 and the outer wall 117. The top of the lower portion 113 may also act to prevent the implement holder 104 from travelling too far on the plate 214 when a user is sliding the implement holder 104 onto the plate 214.

A nozzle opening 116 may be formed through the backplane 112 of the implement holder 104. The nozzle opening 116 may be formed by a wall 118 extending from the backplane 112, and may be generally oblong or another suitable shape. The contents of the can 14 may be dispensed from the spray nozzle 400 through the nozzle opening 218 of the spray cap 200 and the nozzle opening 116 of the implement holder 104, when the implement holder 104 is installed on the spray cap 200. A sidewall 120 may extend from the backplane 112 to form an implement receiving portion 122 that is adapted to accept an implement, such as the brush 100 or the foam pad applicator 102. The implement receiving portion 122 may generally have the same shape of the implement, and may include a locking mechanism 124 to secure the implement to the implement holder 104. In some embodiments, the locking mechanism 124 may include protrusions that engage with corresponding recesses 130 on the side edges 107 of an implement backplane 128, 140 to retain the implement to the implement holder 104. In embodiments, the implement backplane 128, 140 may include an angled perimeter guide 137 to help urge insertion of the implement backplane 128, 140 into the implement holder 104.

The sizes of the implement and the implement holder 104 can vary depending on the particular material used for each component. For example, the material for each component may have different properties, e.g., shrink rates. However, in these situations, the implement holder 104 may still securely retain the implement because the locking mechanism 124 and the recesses 130 may still function as described above regardless of the variation in dimensions.

In some embodiments, the implement holder 104 may further include a heel 125 that has an angled surface with or without rough scrubbing knurlings 126 disposed thereon. The heel 125 may be angled at 30 degrees or another suitable angle to allow a user to rub in the contents of the can 14 into a surface, such as for deep cleaning purposes. The knurlings 126 may be formed on the heel 125 and be disposed at various patterns and angles. In some embodiments, the heel 125 of the implement holder 104 may be a flat surface without scrubbing knurlings. In other embodiments, the implement holder 104 may not include a heel 125 or may have a heel 125 of any other suitable geometry. In some embodiments, heel 125 may be flat and configured to match the height or thickness of the exposed portion of backplane 128,140. In other embodiments, heel 125 may be configured to approximate the height, angle, or profile of bristles 134, foam pad 103, or any other implement mounted to implement holder 104.

An implement comprising brush 100 having bristles 134 in combination with heel 125 from implement holder 104, as shown in FIG. 1, for example, provides a user with the flexibility to brush or rub the dispensed contents onto a surface using the bristles 134 while also providing the user with the ability to deeply rub the dispensed contents into a surface using the leverage provided by the heel 125 of implement holder 104. In some embodiments in which the heel 125 is not present, bristles 134 of brush 100 may be positioned across the entirety of backplane 128,140. In some embodiments in which the heel 125 is not present, backplane 128,140 may be configured to generally match the perimeter contour and/or profile of sidewall 120 of implement holder 104. In some embodiments, the features of any implement, including bristles 134 of brush 100 and foam pad 103 of foam pad applicator 102 may be configured to span any desired area and density across backplane 128,140. In some embodiments, the physical properties and/or performance characteristics of the implement may be relatively consistent across the area in which it is present across backplane 128,140. In some embodiments, the physical properties and/or performance characteristics of the implement may vary across the area in which it is present across backplane 128,140.

The brush 100, as an exemplary implement shown in FIGS. 25-30, may be removably attached to the implement receiving portion 122 of the implement holder 104. The brush 100 may include a backplane 128 that has a nozzle opening 132 formed therein. In some embodiments, the brush 100 may be integrally formed as a part of the backplane 128 from the same material. In other embodiments, the brush 100 may be formed separately from the backplane 128 to permit interchangeability of the brush 100 with a different implement. The nozzle opening 132 may be adapted to fit over the nozzle opening 116 of the implement holder 104, and may be generally oblong or another suitable shape. When the brush 100 and the implement holder 104 are installed on the spray cap 200, the contents of the can 14 may be dispensed through the nozzle opening 218 of the spray can 200, the nozzle opening 116 of the implement holder 104, and the nozzle opening 132 of the brush 100.

Figure 6:
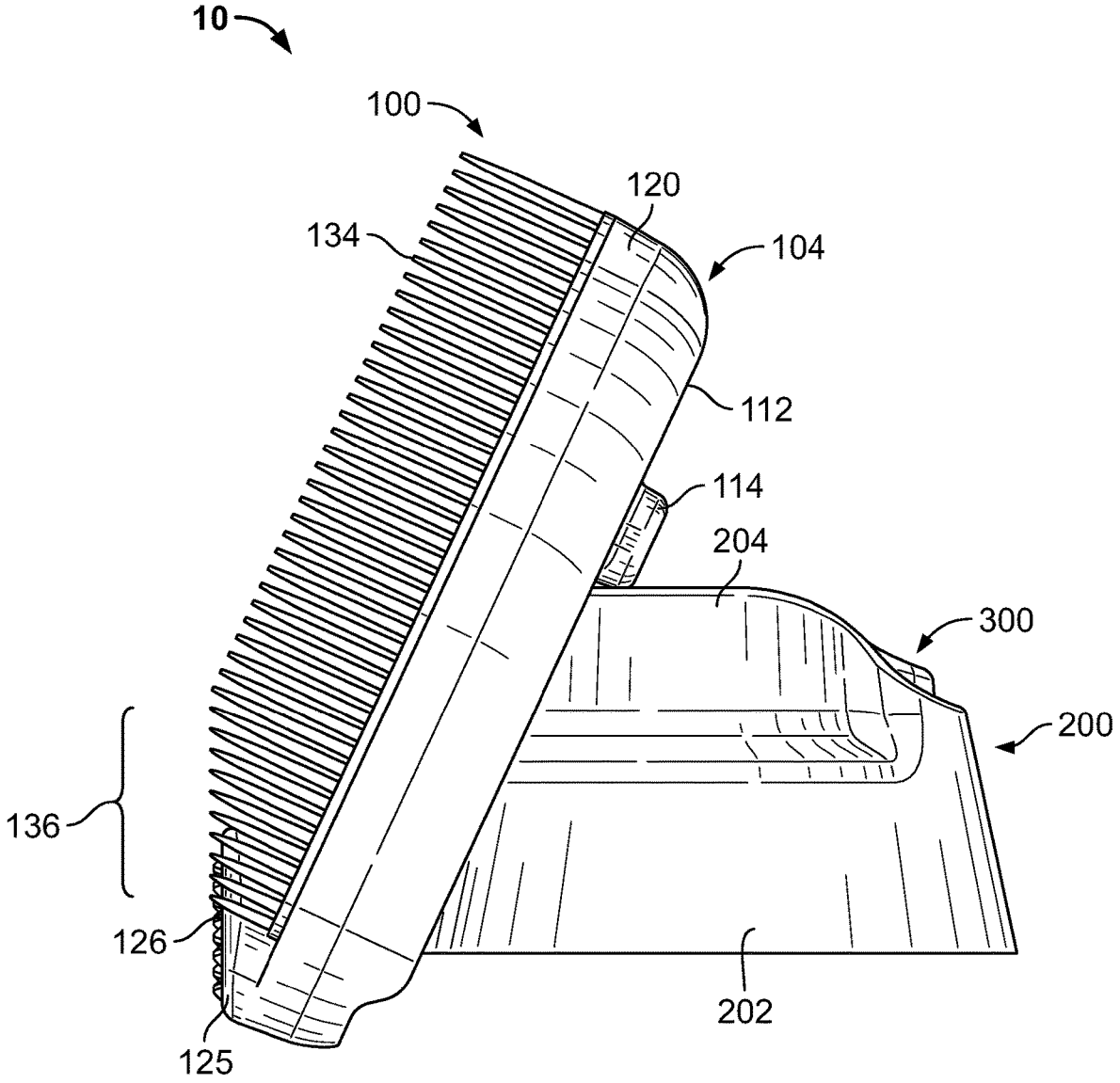
FIG. 6 is a side view of the spray cap system of FIG. 1 without the can.
Figure 7:
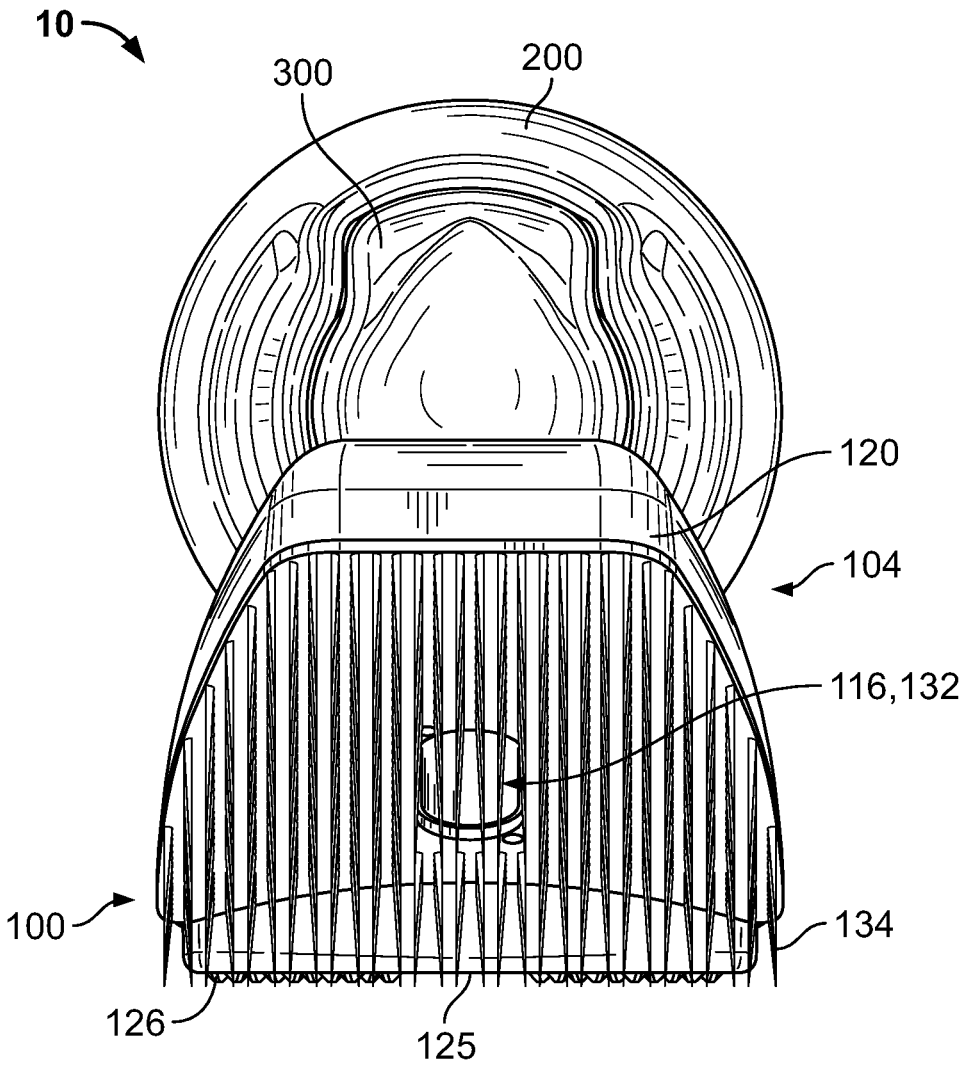
FIG. 7 is a top view of the spray cap system of FIG. 1 without the can.
Figure 8:
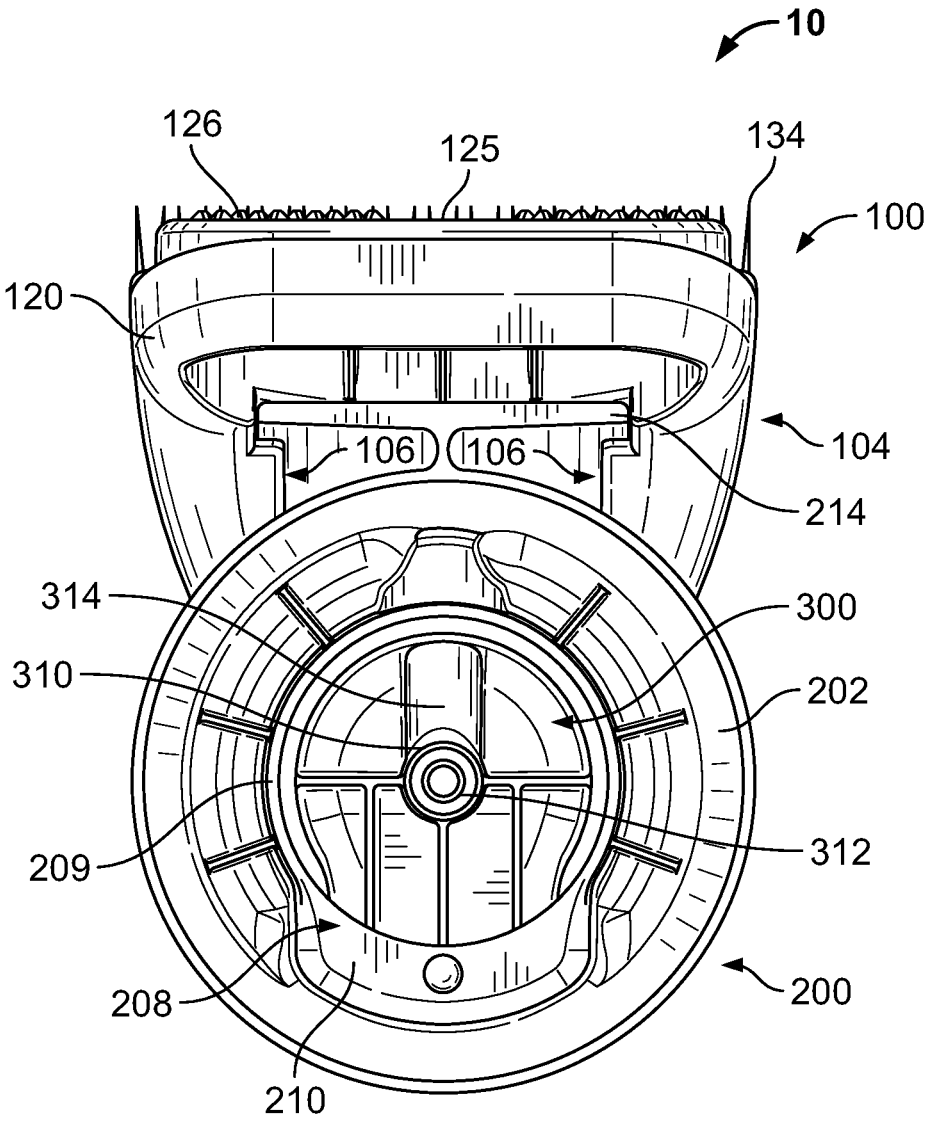
FIG. 8 is a bottom view of the spray cap system of FIG. 1 without the can.
Figure 28:
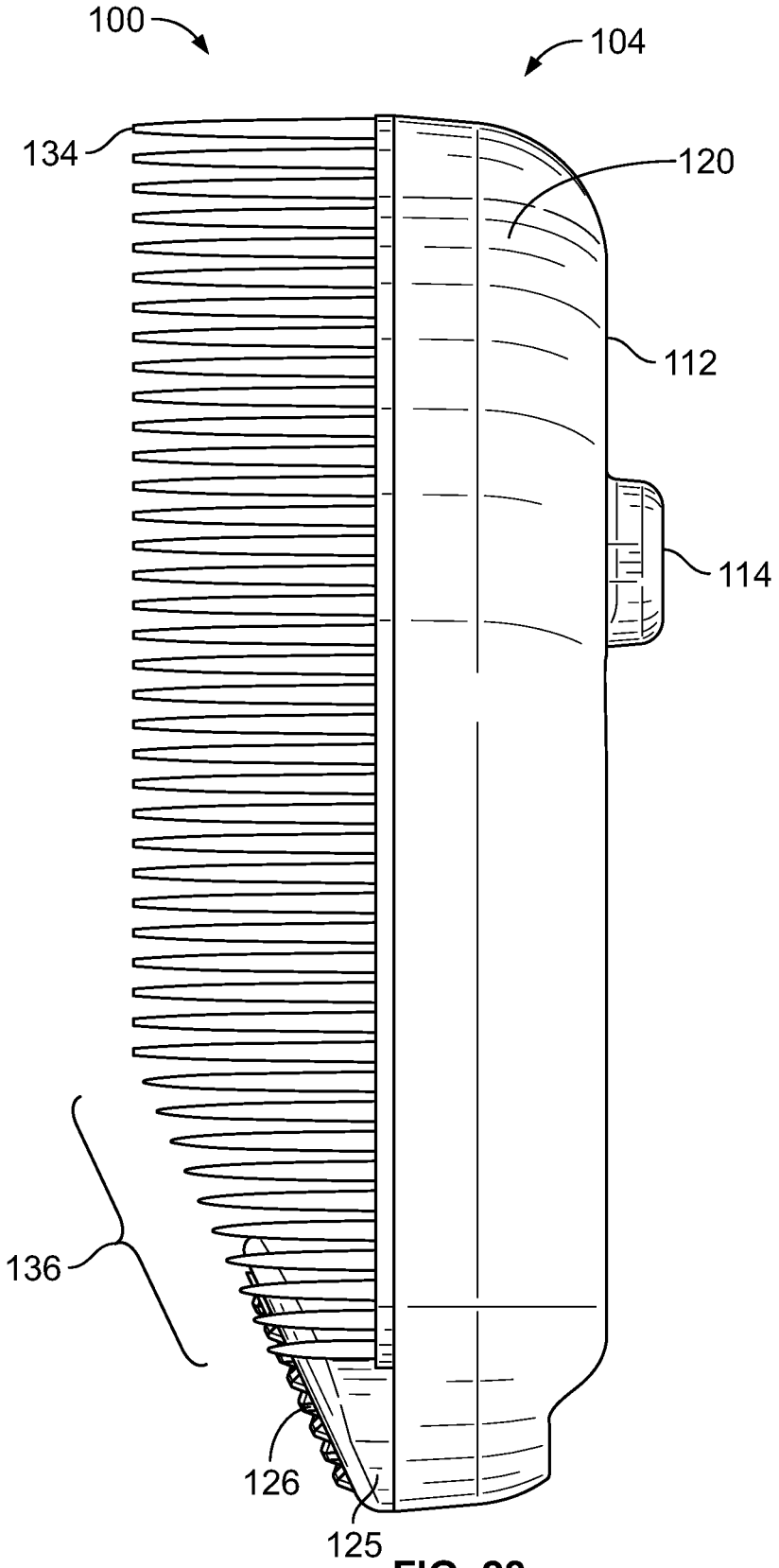
FIG. 28 is a side view of the brush holder and the brush of FIG. 25.
Figure 29:
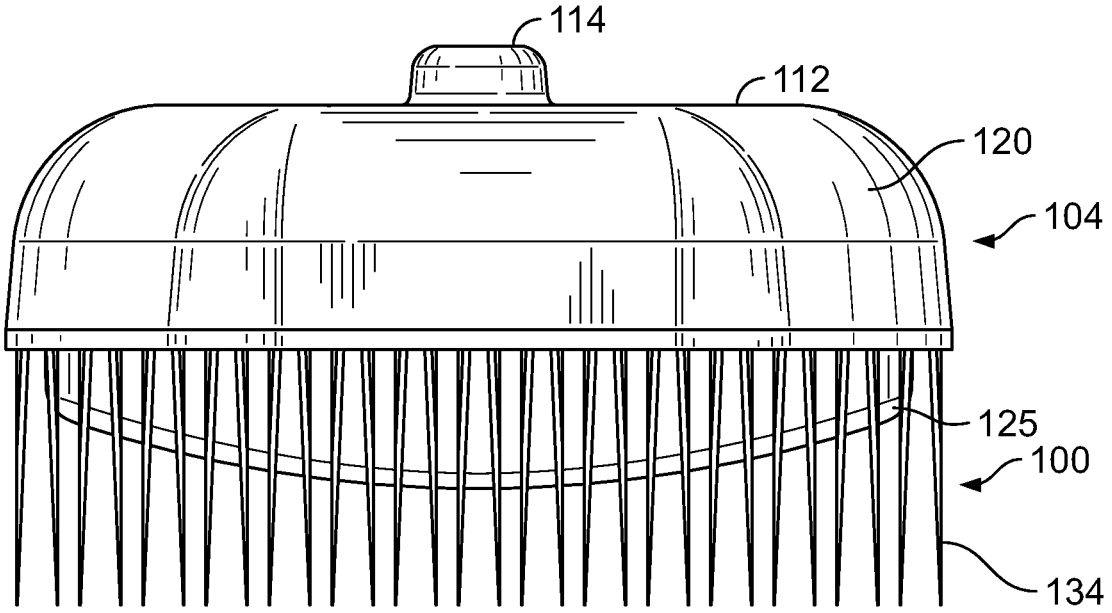
FIG. 29 is a top view of the brush holder and the brush of FIG. 25.
Figure 30:
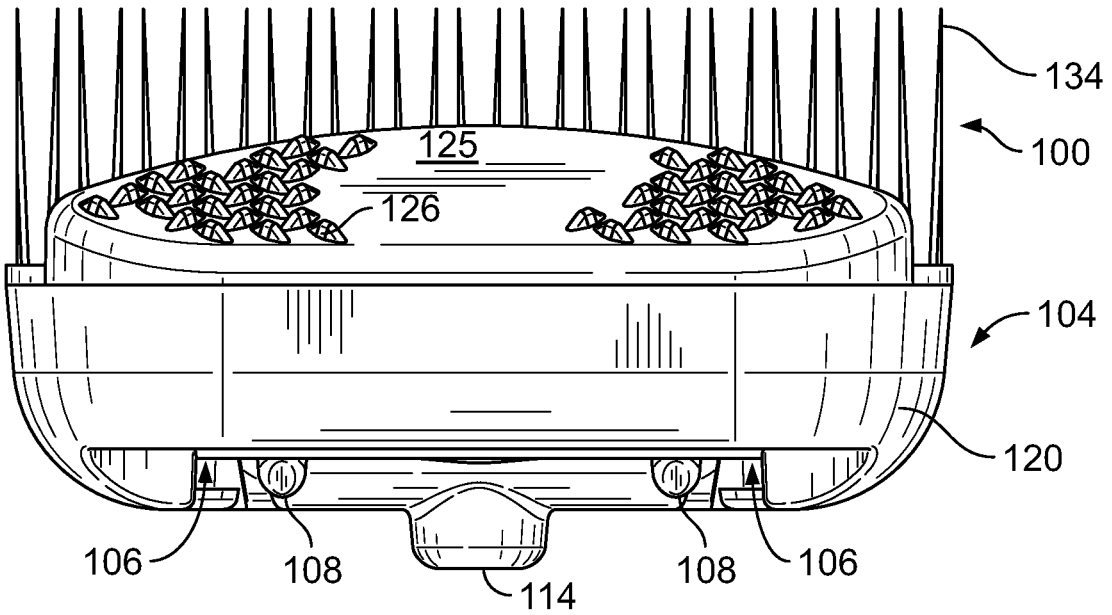
FIG. 30 is a bottom view of the brush holder and the brush of FIG. 25.

In some embodiments, the brush 100 may also include a plurality of resilient bristles 134 formed on an outer surface of the backplane 128 and extending therefrom. In other embodiments, the brush 100 may include the plurality of bristles 134 mounted to a separate backplane 140 (see, e.g., FIG. 3A). The bristles 134 may be utilized by a user to scrub and rub the contents of the can 14 on a surface, for example. In some embodiments, the bristles 134 may have a uniform length. In other embodiments, the bristles 134 may have an angled portion 136, as best shown in FIGS. 6, 13, and 28. The angled portion 136 may include bristles 134 with gradually shorter lengths than the remainder of the bristles 134 that have a uniform length. The angle formed by the angled portion 136 may be approximately the same angle as the heel 125, in some embodiments. A user may be able to work in small, tight, and/or narrow spaces with the angled portion 136 of the brush 100 and the heel 125 and the scrubbing knurlings 126 of the implement holder 104.

In some embodiments, bristles 134 may be relatively short. In some embodiments, bristles 134 may be relatively long. In some embodiments, the length of bristles 134 may vary over any portion of backplane 128,140. In other words, different portions of the bristles 134 may have different bristle lengths, and bristles adjacent one another may have different bristle lengths. In some embodiments, bristles 134 may extend from backplane 128,140 at any angle. In some embodiments, bristles 134 may be relatively soft, relatively stiff, or may vary in softness and/or stiffness over the length of the shaft of each bristle 134. In some embodiments, bristles 134 may have different softness and/or stiffness from one bristle portion to another bristle portion across backplane 128,140.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A spray cap system for dispensing contents from a spray can, comprising:

(A) a spray cap adapted to attach to a spray end portion of the can, the spray cap comprising a body and further comprising:
  a spray button removably connected to the body;
  a spray nozzle connected to the spray button; and
  a planar mount extending from the body; and (B) an implement system removably engaged with the planar mount, the implement system comprising an interchangeable implement removably engaged with an implement receiver, wherein the implement receiver comprises at least one receiving slot slidably engaged with the planar mount.

2. The spray cap system of claim 1, wherein the implement receiver includes:
  a flexible cantilevered hinge lockingly engaged with the planar mount; and
  a receiver spray aperture.

3. The spray cap system of claim 2, wherein the interchangeable implement comprises an implement spray aperture aligned with the receiver spray aperture, wherein the implement spray aperture and the receiver spray aperture are aligned with the spray nozzle when the implement system is engaged with the planar mount.

4. The spray cap system of claim 1, wherein the spray nozzle includes a bowtie shaped orifice for dispensing the contents from the spray can, and first and second trapezoidal protrusions disposed parallel to one another on an outer face of the spray nozzle and adjacent to the orifice.

5. The spray cap system of claim 1, wherein the spray button comprises:
  a nozzle receiver lockingly engaged with the spray nozzle; and
  a flow chamber for conveying the contents of the can to the nozzle receiver.

6. The spray cap system of claim 1, wherein the body includes a keyed receiver adapted to receive and removably retain the spray button.

7. The spray cap system of claim 1, wherein the implement receiver includes a plurality of scrubbing knurlings disposed thereon.

8. The spray cap system of claim 1, wherein the planar mount comprises at least one mating aperture adapted to disengagingly interlock with the implement receiver.

9. The spray cap system of claim 8, wherein the implement receiver includes a flexible cantilevered hinge comprising at least one locking protrusion adapted to engage with the at least one mating aperture of the planar mount.

10. The spray cap system of claim 1, wherein the interchangeable implement comprises at least one of:
  a brush comprising a plurality of resilient bristles; or
  a foam pad applicator comprising a foam pad.

11. A spray cap system for dispensing contents from a spray can, comprising:

(A) a spray cap adapted to attach to a spray end portion of the can, the spray cap comprising:
  a spray button; and
  a spray nozzle comprising:
    an elongated flow chamber;
    a bowtie-shaped orifice in communication with the elongated flow chamber;
    first and second trapezoidal protrusions disposed parallel to one another on an outer face of the spray nozzle and adjacent to the orifice; and
    an orientation element disposed at a flow discharge end of the spray nozzle;

(B) an implement receiver removably, slidably, and lockingly engaged with a planar mount of the spray cap; and (C) an interchangeable implement removably engaged with the implement receiver.

12. The spray cap system of claim 11, wherein the first protrusion is positioned on one side of the orifice and the second protrusion is positioned on an opposite side of the orifice.

13. The spray cap system of claim 11, wherein the orientation element is adapted to maintain an orientation of the spray nozzle relative to the spray button and to prevent rotational movement of the spray nozzle relative to the spray button.

14. The spray cap system of claim 11, wherein the elongated flow chamber comprises a plurality of longitudinal flow channels.

15. The spray cap system of claim 11, wherein the elongated flow chamber comprises a locking detent adapted to interface with a retaining element of the spray button.

16. A spray cap system for dispensing contents from a spray can, comprising:

(A) a spray cap adapted to attach to a spray end portion of the can, the spray cap comprising:

a spray button; and a spray nozzle disposed on the spray button; and (B) an implement receiver removably engaged with the spray cap, comprising:

a flexible cantilevered hinge having:

at least one locking protrusion at a distal end of the hinge, the at least one locking protrusion adapted to engage with at least one corresponding mating aperture of the spray cap; and a stop protruding from the hinge, the stop adapted to align the at least one locking protrusion with the at least one corresponding mating aperture;

a receiving slot slidingly engaged with a plate of the spray cap to attach the implement receiver to the spray cap; and a receiving portion adapted to removably secure an interchangeable implement to the receiving portion.

17. The spray cap system of claim 16, wherein the receiving portion comprises a locking mechanism adapted to removably secure the interchangeable implement to the receiving portion.

18. The spray cap system of claim 16, wherein the implement receiver includes a receiver spray opening aligned with the spray nozzle.

19. The spray cap system of claim 16, wherein the implement receiver includes a plurality of knurlings disposed thereon.

20. The spray cap system of claim 16, including an interchangeable implement removably engaged with the implement receiver, wherein an angled guide extending from the interchangeable implement urges engagement of the interchangeable implement with the implement receiver.

* * * * *